US007377606B2

(12) United States Patent
Yoshida

(10) Patent No.: US 7,377,606 B2
(45) Date of Patent: May 27, 2008

(54) PRINTING IN DIFFERENT MODES ACCORDING TO IMAGE SIZE

(75) Inventor: Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 715 days.

(21) Appl. No.: 10/684,822

(22) Filed: Oct. 15, 2003

(65) Prior Publication Data

US 2004/0136019 A1 Jul. 15, 2004

(30) Foreign Application Priority Data

Oct. 16, 2002 (JP) ..... 2002-302001

(51) Int. Cl.
*B41J 29/38* (2006.01)

(52) U.S. Cl. ..... 347/9; 347/5; 347/16

(58) Field of Classification Search ..... 347/16, 347/19, 12, 41, 5, 9; 358/1.9, 1.13
See application file for complete search history.

(56) References Cited

U.S. PATENT DOCUMENTS

| | | | | |
|---|---|---|---|---|
| 6,250,734 | B1 * | 6/2001 | Otsuki | 347/16 |
| 6,547,370 | B2 * | 4/2003 | Mantell et al. | 347/41 |
| 6,832,824 | B1 * | 12/2004 | Baker et al. | 347/19 |

FOREIGN PATENT DOCUMENTS

| | | | |
|---|---|---|---|
| JP | 02-196662 | | 8/1990 |
| JP | 09-11509 | | 1/1997 |
| JP | 2000-25208 | | 1/2000 |
| JP | 2000-25210 | A | 1/2000 |
| JP | 2000-343688 | | 12/2000 |
| JP | 2001-001510 | A | 1/2001 |
| JP | 2001-121688 | | 5/2001 |
| JP | 2001-232806 | A | 8/2001 |

* cited by examiner

*Primary Examiner*—Lam Son Nguyen
(74) *Attorney, Agent, or Firm*—Sughrue Mion, PLLC

(57) ABSTRACT

When a relatively large image in the sub-scanning direction is to be printed, a relatively large number of dot-forming elements among a plurality of dot-forming elements are used to form dots by means of sub-scanning with a relatively large average feed. When a relatively small image in the sub-scanning direction is to be printed multiple times at different positions in the sub-scanning direction on the same print medium, a relatively small number of dot-forming elements among the plurality of dot-forming elements are used to form dots by means of sub-scanning with a relatively low average feed. With this embodiment, large images are rapidly printed, and small images are printed more efficiently on printing paper.

17 Claims, 19 Drawing Sheets

Fig.11

| | Number Of Nozzles Used | Feed | 16-Line Image Printing | | 200-Line Image Printing |
|---|---|---|---|---|---|
| | | | Printable Percentage | Average Number Of Processing Passes | Overall Number Of Processing Passes |
| High Speed Mode | 13 | 13 | 41.0% | 4 | 19 |
| Paper Conserving Mode | 5 | 5 | 64.0% | 6 | 43 |

Fig.18

| | Number Of Nozzles Used | Feed | 16-Line Image Printing | | 200-Line Image Printing |
|---|---|---|---|---|---|
| | | | Printable Percentage | Average Number Of Processing Passes | Overall Number Of Processing Passes |
| High Speed Mode | 13 | 13 | 41.0% | 4 | 19 |
| Paper Conserving Mode | 5 | 5 | 76.2% | 8 | 69 |
| Divided Mode | 3×2 | 3 | - | - | - |

| | Number Of Nozzles Used | Feed | Two 16-Line Images Printing | |
|---|---|---|---|---|
| | | | Overall Feed | Overall Number Of Processing Passes |
| High Speed Mode | 13 | 13 | 39 dots | 8 |
| Paper Conserving Mode | 5 | 5 | 42 dots | 16 |
| Divided Mode | 3×2 | 3 | 21 dots | 8 |

PRINTING IN DIFFERENT MODES ACCORDING TO IMAGE SIZE

BACKGROUND OF THE INVENTION

1. Field of the Invention

The present invention relates to a technique for printing dots on the surface of a print medium using dot printing heads, and in particular to a technique for efficiently printing large and small images.

2. Description of the Related Art

Printers which eject ink from the nozzles of printing heads have recently come to enjoy broad popularity as computer output devices. Such printers with numerous nozzles can print dots for rapid printing of large images by using these numerous nozzles at once. These techniques are disclosed, for example, in Japanese Unexamined Patent Application (Kokai) 2001-232806.

FIG. 19 illustrates an example of interlace printing. Interlace printing is sometimes employed in the above printers in order to achieve high quality printing. During interlace printing, various parts of the printed image Img are printed with various nozzles For example, the parts at the top edge of the image Img are printed by nozzles #10 and #11 near the upstream end (bottom end in FIG. 19) in the sub-scanning direction SS among the nozzle rows, and are printed by nozzle #1 near the downstream end (top end in FIG. 19) of the sub-scanning direction SS. The parts near the bottom end of the image Img are printed by nozzle #12 near the upstream end in the nozzle rows, and are printed by nozzles #2 and #3 near the downstream end of the nozzle rows.

During interlace printing, the image Img begins to be printed, as illustrated in FIG. 19, at a position where nozzles #10 and #11 near the upstream end (bottom end in FIG. 19) of the nozzle rows face the top end of the image Img. The image Img ends to be printed at a position where nozzles #3 and #4 near the downstream end (top end in FIG. 19) of the nozzle rows face the top end of the image Img.

Meanwhile, at the start of interlace printing, the main scan lines cannot be printed without gaps in the area where the downstream side nozzles (nozzles #1, #2, etc.) print. Thus, in a case where the next image Img begins to be printed after the first image Img (indicated by the aggregate of solid circles in FIG. 19) has been printed, and the printing of the next image begins from the specific relative position of the printing head and print medium where the first image Img has been completed, the next image Img is printed at the position indicated by the dashed line in FIG. 19.

Accordingly, when images are printed multiple times on continuous paper, the images have had to be printed at certain intervals. Thus, in the case of smaller printed images, the images are not printed proportionately to the surface area of the printing paper that can be used to print the images, resulting in a greater waste of printing paper area.

An object of the invention is to provide a technique that allows large images to be rapidly printed and smaller images to be more efficiently printed on a printing medium, such as paper, in order to address the above drawbacks in the related art.

SUMMARY OF THE INVENTION

In the present invention, a certain process is employed in dot printing devices for printing dots on the surface of a print medium in order to address at least some of the above drawbacks. In one embodiment, this dot printing device comprises: a dot printing head having a plurality of dot-forming elements for forming dots on a print medium; a main scanning driver for executing main scanning by moving at least one of the dot printing head and the print medium; a head driver for driving at least some of the plurality of dot-forming elements to form dots during the main scanning; a sub-scan driver for executing sub-scanning by moving the print medium in a direction perpendicular to a direction of the main scanning between the main scannings; and a control unit for controlling the main scanning driver, the head driver, and the sub-scan driver.

With such a printer, a printing mode may be selected; and an image may be printed according to the selected mode. In the printing of the image, main scanning may be executed by moving at least one of a dot printing head and a print medium, and sub-scanning may be executed by moving the print medium in a direction perpendicular to a direction of the main scanning between the main scannings. In the selecting a printing mode, one of a first printing mode and a second printing mode may be selected. The first printing mode is preferably the printing mode wherein, when a relatively large image in a direction of the sub-scanning is to be printed, a relatively large number of dot-forming elements are used to form dots and a sub-scanning with a relatively large average feed are executed. The second printing mode is preferably the printing mode wherein, when a relatively small image in the direction of the sub-scanning is to be printed, a relatively small number of dot-forming elements are used to form dots and a sub-scanning with a relatively small average feed are executed. Such an embodiment allows large images to be rapidly printed and smaller images to be more efficiently printed on printing paper.

Printing in the second printing mode is particularly effective for when relatively small images are printed multiple times at varying positions in the sub-scanning direction on the same print medium. Printing in the second printing mode is thus effective, for example, when the print medium is a roll of paper.

In another embodiment, the sub-scanning may be executed with a relatively large fixed first feed in the first printing mode; and the sub-scanning may be executed with a relatively low fixed second feed in the second printing mode. Such an embodiment allows printing to be done with a simple process.

In yet another embodiment, the sub-scanning may be executed repeatedly with a combination of a plurality of feeds in the first printing mode, an average of the plurality of feeds in the first printing mode being relatively large; and the sub-scanning may be executed repeatedly with a combination of a plurality of feeds in the second printing mode, an average of the plurality of feeds in the second printing mode being relatively low. Such an embodiment will permit high-quality printing. Further in the invention, sub-scanning may be done repeatedly with a combination Of a plurality of feeds, the maximum of which is relatively large, during the first printing mode; and sub-scanning may be done repeatedly with a combination of a plurality of feeds, the average of which is relatively low, during the second printing mode. The combination of feeds is preferably a combination of feeds that are different from each other.

Dots may be printed with a first-use dot-forming element group and a second-use dot-forming element group during a same main scanning to print first and second images. The first-use dot-forming element group comprises dot-forming elements in a relatively upstream range in the direction of the sub-scanning. The second-use dot-forming element group comprises dot-forming elements in a relatively downstream range in the direction of the sub-scanning. Particularly, printing in the second printing mode can also be done using a first-use dot-forming element group comprising a relatively small number of dot-forming elements in a relatively upstream range in the sub-scanning direction and a second-use dot-forming element group comprising a relatively small number of dot-forming elements in a relatively downstream range in the sub-scanning direction. In this aspect, the first image may be printed with the first-use dot-forming element group solely, and the second image may be printed with the first-use dot-forming element group solely. Such an embodiment permits printing to be accomplished with fewer main scans than when printing in first printing mode to print the same image.

The invention can also be realized, for example, in the following embodiments described herein:

1) dot printing method, printing control method, control method;

2) dot printing device, printing controller, controller;

3) computer programs to run the above devices or methods;

4) recording media for recording computer programs to run the above devices or methods; and 5) data signals realized in carrier waves, including computer programs for running the above devices or methods.

These and other objects, features, aspects, and advantages of the present invention will become more apparent from the following detailed description of the preferred embodiments with the accompanying drawings.

BRIEF DESCRIPTION OF THE DRAWINGS

FIG. 11 is a table comparing high speed mode and paper conserving mode;

FIG. 18 is a table comparing high speed mode, paper conserving mode, and divided mode.

DETAILED DESCRIPTION OF THE INVENTION

Some aspects of the invention are described in the following with reference to embodiments.

A. FIRST EXAMPLE

A1. Device Structure

Figure 1:
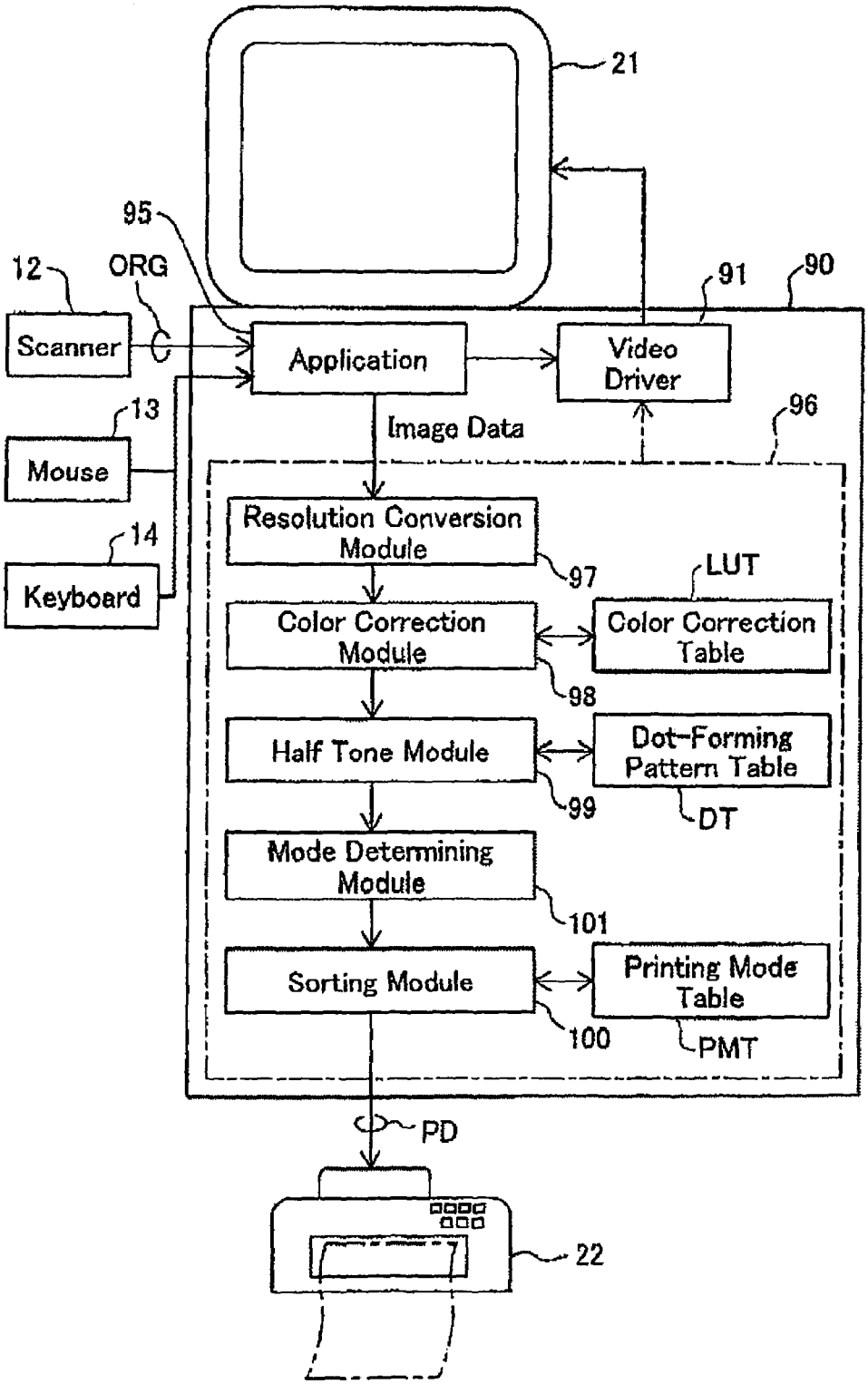
FIG. 1 is a block diagram of the printing device software structure.

FIG. 1 is a block diagram of the structure of the software for a printing device according to an embodiment of the invention. This printing system is furnished with a computer 90 as a printer controller. The printer 22 and computer 90 can be referred to as the printing device in the broad sense. An application program 95 is run under the appropriate operating system of the computer 90. The operating system includes a video driver 91 and printer driver 96. Image data for transmission to the printer 22 is output from the application program 95 through these drivers. An application program 95 for retouching images reads the image from a scanner 12, and the image is displayed on a CRT 21 via the video driver 91 as the image is appropriately processed. The data from the scanner 12 is the original color image data ORG consisting of the three color components red (R), green (G), and blue (B), as read from the color original.

After the application program 95 generates a control command, the printer driver 96 of the computer 90 receives the image data from the application program 95, and the data are converted by the printer to processable signals (in this case, signals of many values for cyan, magenta, light cyan, light magenta, yellow, and black) In the example illustrated in FIG. 1, the printer driver 96 comprises a resolution conversion module 97, color correction module 98, half tone module 99, sorting module 100, and mode determining module 101. A color correction table LUT, dot-forming pattern table DT, and printing mode table PMT are also stored.

The resolution conversion module 97 serves to convert the resolution, that is, the number of pixels per unit length, of the color image data handled by the application program 95 to a resolution which can be handled by the printer driver 96. Because the resulting image data with the converted resolution is image data consisting of three colors (RGB), the color correction module 98 converts it, while referencing the color correction table LUT, to data for each of the colors (cyan (C), magenta (M), light cyan (LC), light magenta (LM), yellow (Y), and black (K)) for use by the printer. A pixel is a theoretically defined grid-shaped measure on a print medium (and beyond the print medium in some cases) to determine positions where drops of ink are deposited to print dots.

The color-corrected data has a gray scale value in the range of a 256 gray scale, for example. The half tone module 99 runs a half tone process to express the gray scale value with the printer 22 by forming dots in the specific density. The half tone module 99 runs the half tone process upon setting the dot-forming pattern of the various ink dots according to the gray scale value of the image data.

Meanwhile, the mode determining module 101 determines the printing mode. The process with the mode determining module 101 is described below. The image data which has undergone the half tone process and for which the printing mode has been determined by the mode determining module 101 is sorted by the sorting module 100 (with reference to the printing mode table PMT) according to the order in which it is to be sent to the printer 22. It is then output in the form of the final printing data PD. The printing data PD includes raster data showing the printing configuration o f the dots during main scanning and data showing the sub-scanning feed. In this example, the printer 22 served only to form ink dots according to the printing data PD and did not carry out the imaging process, but the printer 22 may, of course, also carry out those processes. The printer driver 96 corresponds to the "first printing data generator" and "second printing data generator".

Figure 2:
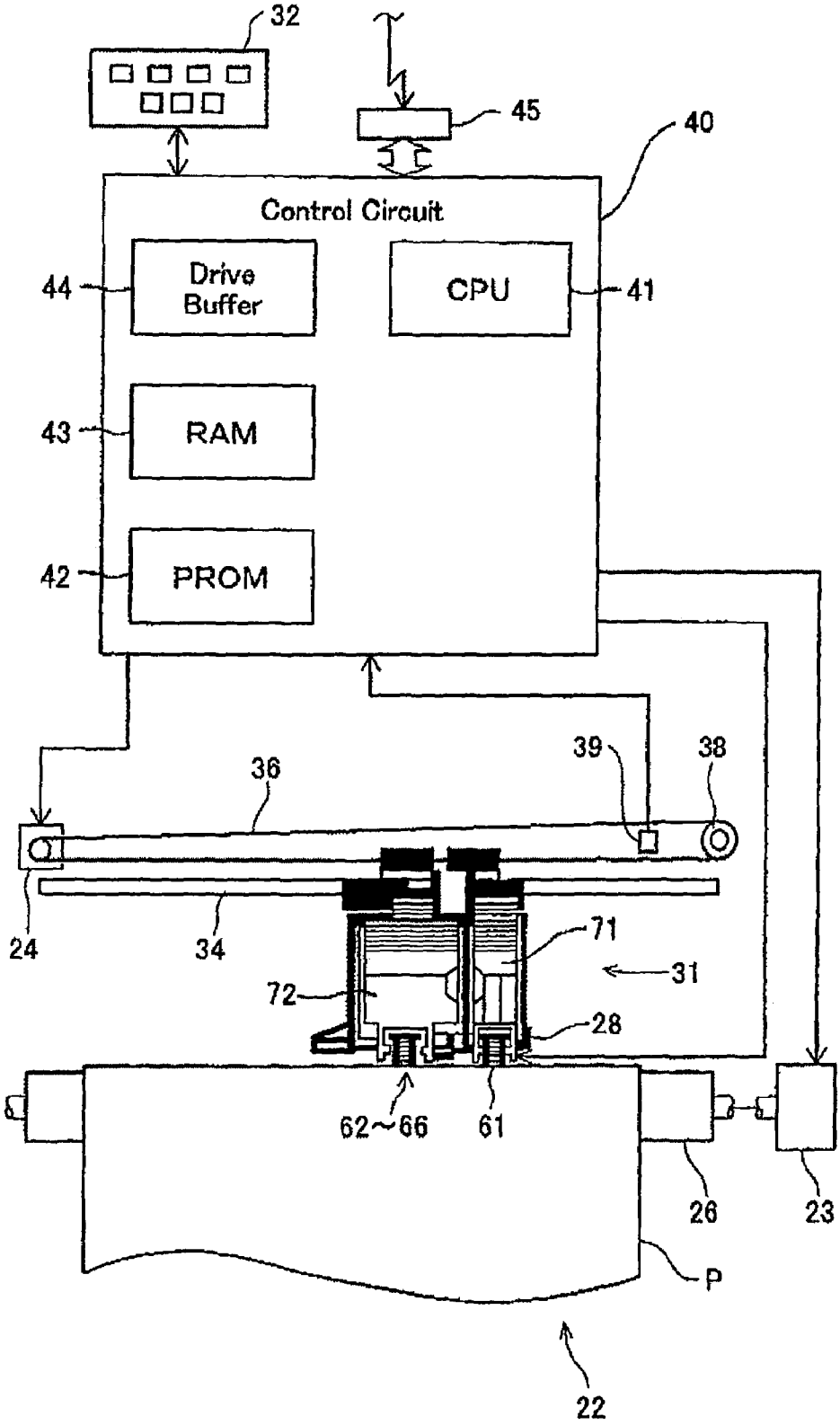
FIG. 2 is an illustration of the general structure of a printer.

The general structure of the printer 22 is illustrated by FIG. 2. As illustrated, the printer 22 comprises a mechanism for conveying paper P by means of a paper feed motor 23, a mechanism for allowing a carriage 31 to be moved back and forth by a carriage motor 24 in the direction perpendicular to the direction in which the paper P is conveyed, a mechanism for driving a printing head 28 mounted on the carriage 31 so as to eject ink and form ink dots, and a control circuit 40 for signaling with the paper feed motor 23, carriage motor 24, printing head 28, and operation panel 32 so as to control them.

The mechanism for allowing the carriage 31 to be moved back and forth in the direction perpendicular to the direction in which the paper P is conveyed comprises a sliding shaft 34 which is suspended in the direction perpendicular to the direction in which the paper P is conveyed and on which the carriage 31 is slidably retained, a pulley 38 for suspending an endless drive belt 36 between the carriage 31 and the carriage motor 24, and a position sensor 39 for sensing the starting point position of the carriage 31.

A black ink (K) cartridge 71 and a color ink cartridge 72 housing six colors of ink (cyan (C), light cyan (LC), magenta (M), light magenta (LM), yellow (Y)) can be mounted on the carriage 31. A total of six ink ejecting heads 61 through 66 are formed in the printing head 28 at the bottom of the carriage 31. The black (K) ink cartridge 71 and color ink cartridge 72 can be mounted from above onto the carriage 31 to supply ink from the ink cartridges to the ejecting heads 61 through 66.

The printer 22 also comprises a rolled paper holder (not shown) in which rolls of paper can be set up as the printing paper P. Rolls of paper are print media wound around a spool. Because rolls of paper are prepared in a form wound around a spool, the length in the direction perpendicular to the spool is often at least 10 times greater than in the widthwise direction of the spool around which the paper is wound. The tip of the roll of paper which has been set up in the rolled paper holder is pulled out and is conveyed by a feed roller driven by the paper feed motor 23 to a position facing the printing head 28. The roll of paper is gradually pulled off the spool as the tip of the printing paper P is fed by the feed roller. The printing paper P on which an image has been printed by the printing head 28 is fed downstream from the position facing the printing head 28 by means of the feed roller.

The printer 22 also comprises a cutter (not shown) downstream in the direction in which the printing paper P is feed relative to the printing head 28. The cutter is at least as wide as the width of the print medium, and is disposed perpendicular to the direction in which the printing paper P is fed. Printing paper P which has been printed with images and has been fed downstream by means of the feed roller from the position where it faced the printing head 28 is cut from the back end by the cutter.

Figure 3:
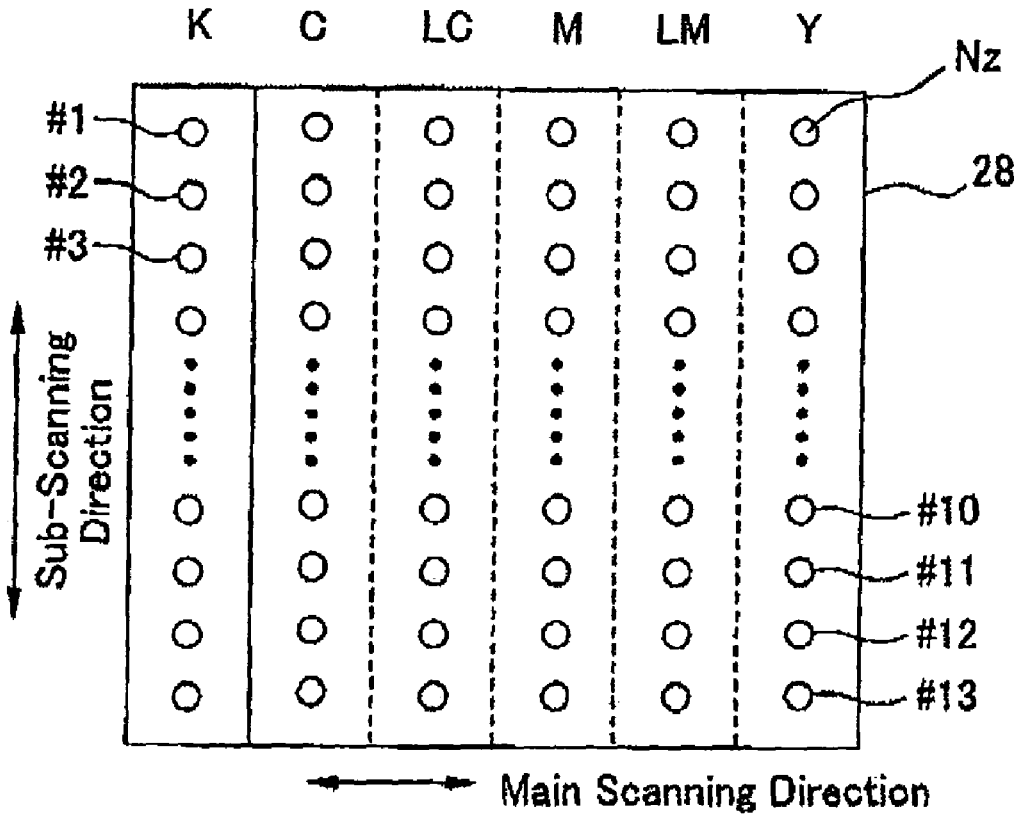
FIG. 3 is a plan of an example of the layout of nozzle units for each color in a printer head unit.

FIG. 3 illustrates the layout of ink jet nozzles Nz in the printing head 28. The nozzle layout consists of 6 groups of nozzle arrays for ejecting black (K), cyan (C), light cyan (LC), magenta (M), light magenta (LM), and yellow (Y) ink, where 13 nozzles are arranged in a row at a given nozzle pitch k. The 6 groups of nozzle arrays are arranged so as to line up along the main scanning direction. The "nozzle pitch" is the value expressing how many dots worth (that is, pixels worth) is the interval in the sub-scanning direction between the nozzles disposed on the printing head.

A2. Printing

In this example, printing is done in two modes: high speed mode and printing paper conserving mode. Interlace printing is done in either mode. "Interlace printing" involves repeated operations, where dots are printed on one or more new main scan lines in new printing areas as dots are printed in main scan lines at intervals from previously printed main scan lines. In interlace printing, there is always some overlap between the range where main scan line groups which have already been printed are located and the range where main scan line groups of newly printed dots are located. Also, because adjacent main scan lines are printed by different nozzles, the features of the nozzles are not readily reflected by the print in specific areas. This results in print of high quality.

Figure 4:
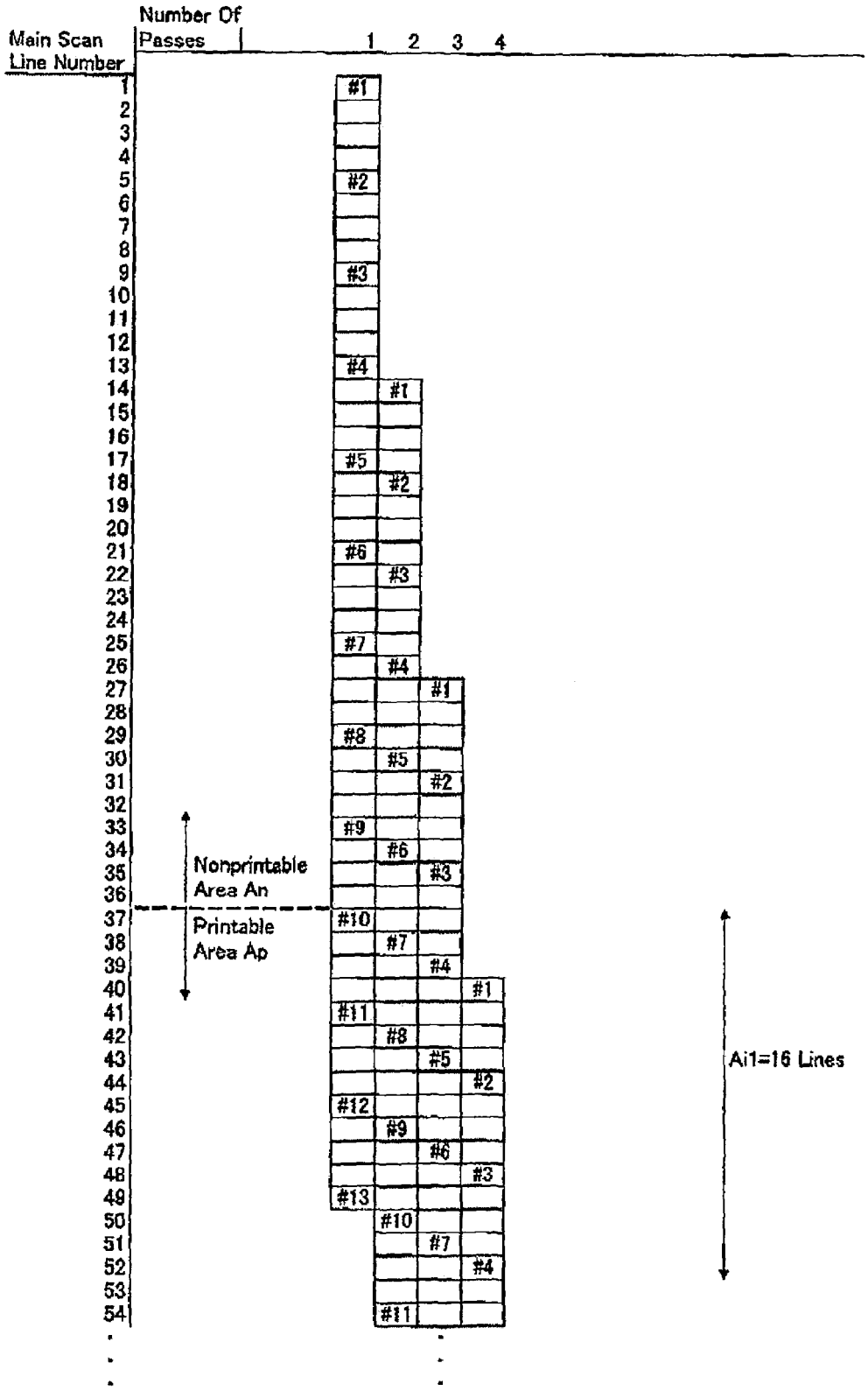
FIG. 4 is an illustration of how the main scan lines are printed by which nozzles in high speed mode.
Figure 5:
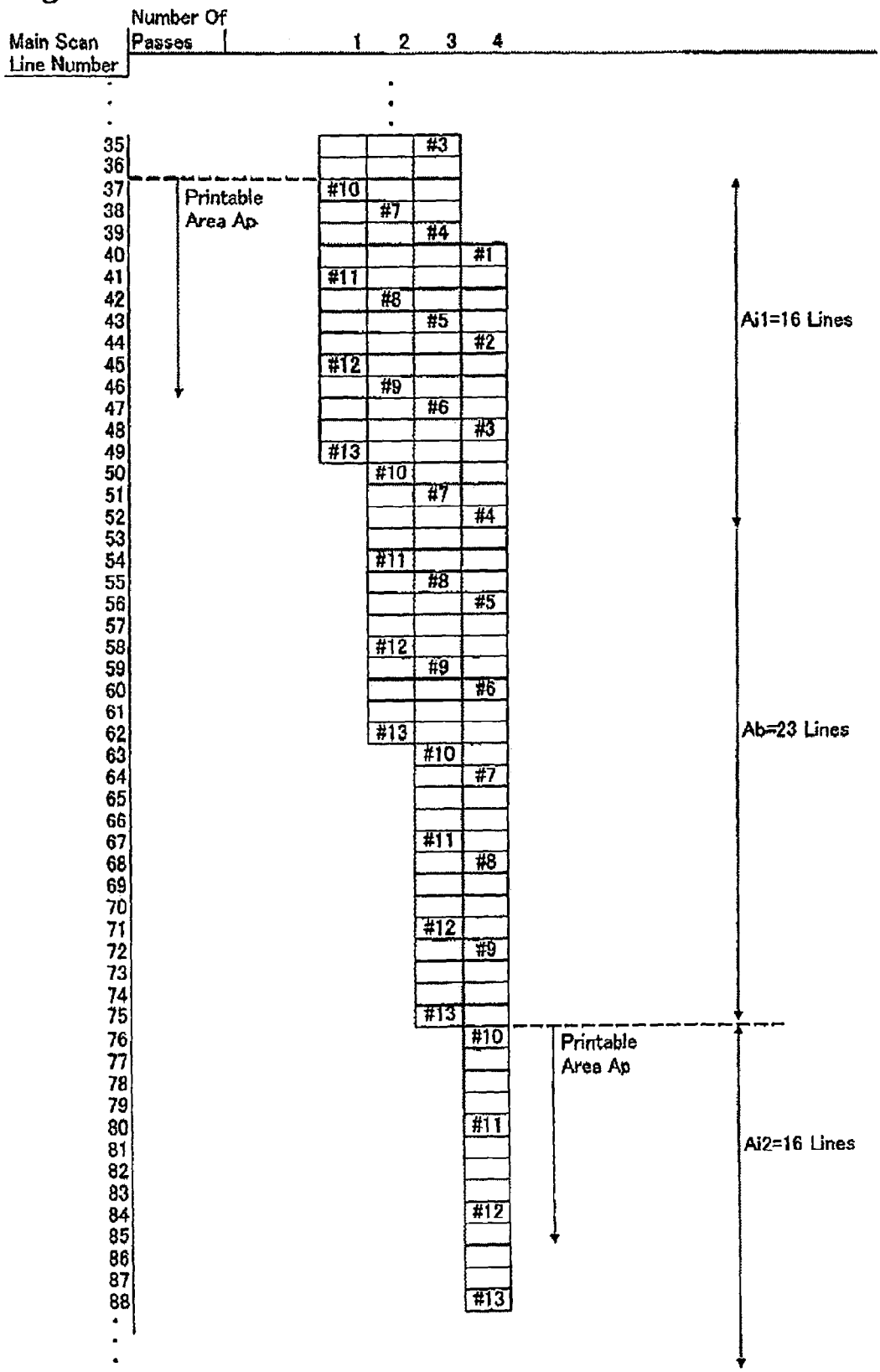
FIG. 5 is an illustration of how the main scan lines are printed by which nozzles in high speed mode.

(1) High Speed Mode: FIGS. 4 and 5 illustrate how main scan lines are printed by which nozzles in high speed mode. Only one row of nozzles is used in the description for the sake of convenience. During main scanning, each nozzle prints one main scan line. Here, "main scan line" is a row of pixels lined up in the main scanning direction. "Pixels" are theoretically defined grid-shaped measures on a print medium to determine positions where drops of ink are deposited to print dots. Here, each nozzle is disposed at a pitch of 4 dots (k=4).

In FIGS. 4 and 5, the vertical row of measures indicates the printing head 28. Numbers 1 through 13 in the measures indicate nozzle numbers. In the present Specification, the symbol "#" is attached to these numbers to indicate each nozzle. Numbers in descending sequence are given on the left side of FIGS. 4 and 5 for the main scan lines which the nozzles on the printing head 28 are able to print. The same is true in the figures illustrating the printing of the dots.

The printing head 28 which is conveyed in the sub-scanning direction relative to the printing paper P over time is depicted as being staggered from left to right. In actuality, the printing paper P is conveyed relative to the printing head with the relative positions between the two being changed, but the printing head is depicted as if it is moving down relative to the printing paper P to simplify the description. As illustrated in FIG. 4, sub-scanning feed is done 13 dots at a time using 13 nozzles during printing in high speed mode. This high speed mode printing is the printing in "first printing mode".

In the present Specification, the terms "top end" and "bottom end" are sometimes used when referring to the ends of the printing paper P in relation to the vertical image data printed on the printing paper P. The terms "front end" and "back end" are used when referring to the ends of the printing paper P in relation to the direction in which the sub-scanning feed of the printing paper P progresses on the printer 22. When indicating the position of nozzles in the nozzle group (nozzle array), the terms "top end" and "bottom end" are used when indicating the position of the nozzles in relation to the vertical image data printed on the printing paper P. The terms "front end" and "back end" are used when referring to the position of the nozzles in relation to the direction in which the sub-scanning feed of the printing paper P progresses on the printer 22. In the present Specification, the "top end" of the printing paper P corresponds to the "front end," and the "bottom end" corresponds to the "back end." When describing the direction in which the printing paper is conveyed during the paper feed, the "top end" and "front end" are the ends located in the downstream direction of the sub-scanning feed, and "bottom end" and "back end" are the ends located in the upstream direction of the sub-scanning feed. In the present Specification, when describing the printing of dots on the printing paper, "top" refers to the front end direction when the printing paper P is fed by means of the paper feed motor 23, and "bottom" refers to the back end direction.

Each nozzle is responsible for one main scan line during main scanning in this example. However, in FIG. 4, the nozzles do not go past the $36^{th}$ main scan line from the top (referred to below as the $36^{th}$ line; same for other main scan lines) in main scanning during printing. The same is true of the $32^{nd}$ and $28^{th}$ lines, etc. That is, the main scan lines are not printed without gaps in the region above the $36^{th}$ line. As such, in this example, the region from the $36^{th}$ line and above is not used to print images.

The main scan lines used to print images in this example are the $37^{th}$ scan lines and below from the upstream end in the sub-scanning direction among the main scan lines in which the nozzles on the printing head 28 can print dots partially. The main scan line area which can be used to print images is referred to as the "printable area." In FIGS. 4 and 5, the printable area is designated as Ap, and the nonprintable area is designated as An.

In cases where an image Img with a range of 16 dots is printed in the sub-scanning direction, for example, in high speed printing mode, the main scan line at the top end of the image Img is located at the $37^{th}$ line at the top end of the printable area. The image Img is therefore printed in 16 lines, from the $37^{th}$ to the $52^{nd}$ lines. The area where the image Img is printed is designated as Ai1 in FIGS. 4 and 5.

As shown in FIG. 4, in high speed mode, Dots can be printed in all the main scan lines included in the range Ai1 when main scanning is done 4 times. After the fourth main scan line is finished, nozzle #1 is at the $40^{th}$ line position as illustrated in FIG. 5.

The following is a case in which another image is printed after the image Img has been printed in the range Ai1. As is evident from FIG. 4, the printable area Ap is the area of the main scan line where nozzle #10 is located, and the area below, where the standard is the corresponding position of the nozzle row at the start of printing. As such, after the first image has been printed, and the next image is to be printed, the area where the image can be printed is the main scan line where nozzle #10 is located at that time and the area below. That is, it is the area of the $76^{th}$ line and below in FIG. 5. The next image is accordingly printed in 16 lines, from the $76^{th}$ line to the $91^{st}$ line. The area where the next image is printed is designated Ai2 in FIG. 5. A 23-line blank area Ab is between the bottom end of Ai1 and the top end of Ai2.

The same can be said for the next printed image. That is, when images with a range of 16 dots in the sub-scanning direction are printed multiple times in high speed mode, a 23-line blank area is put between each image.

Figure 6:
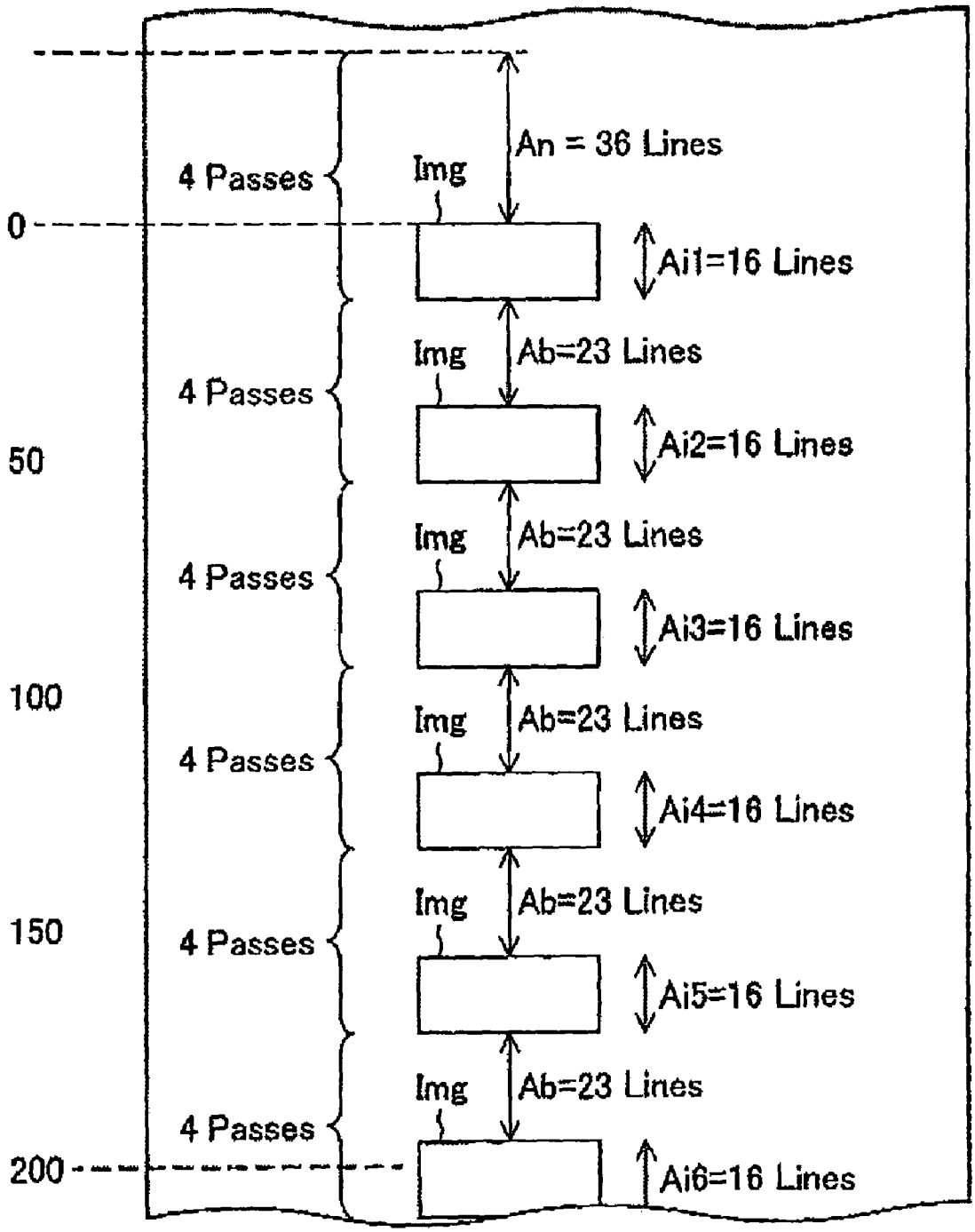
FIG. 6 is an illustration of the effects of printing when images with a range of 16 dots in the sub-scanning direction are repeatedly printed in high speed mode.

FIG. 6 illustrates the results of printing when images with a range of 16 dots in the sub-scanning direction are printed multiple times In high speed mode. In FIG. 6, the areas where images Img are printed are designated Ai1 through Ai6. Each image Img is printed with a 23-line blank area Ab between them. As a result, five images Img are printed in zones with a range of 200 lines in the sub-scanning direction. Each image Img is printed in 4 passes (see FIG. 4).

Figure 7:
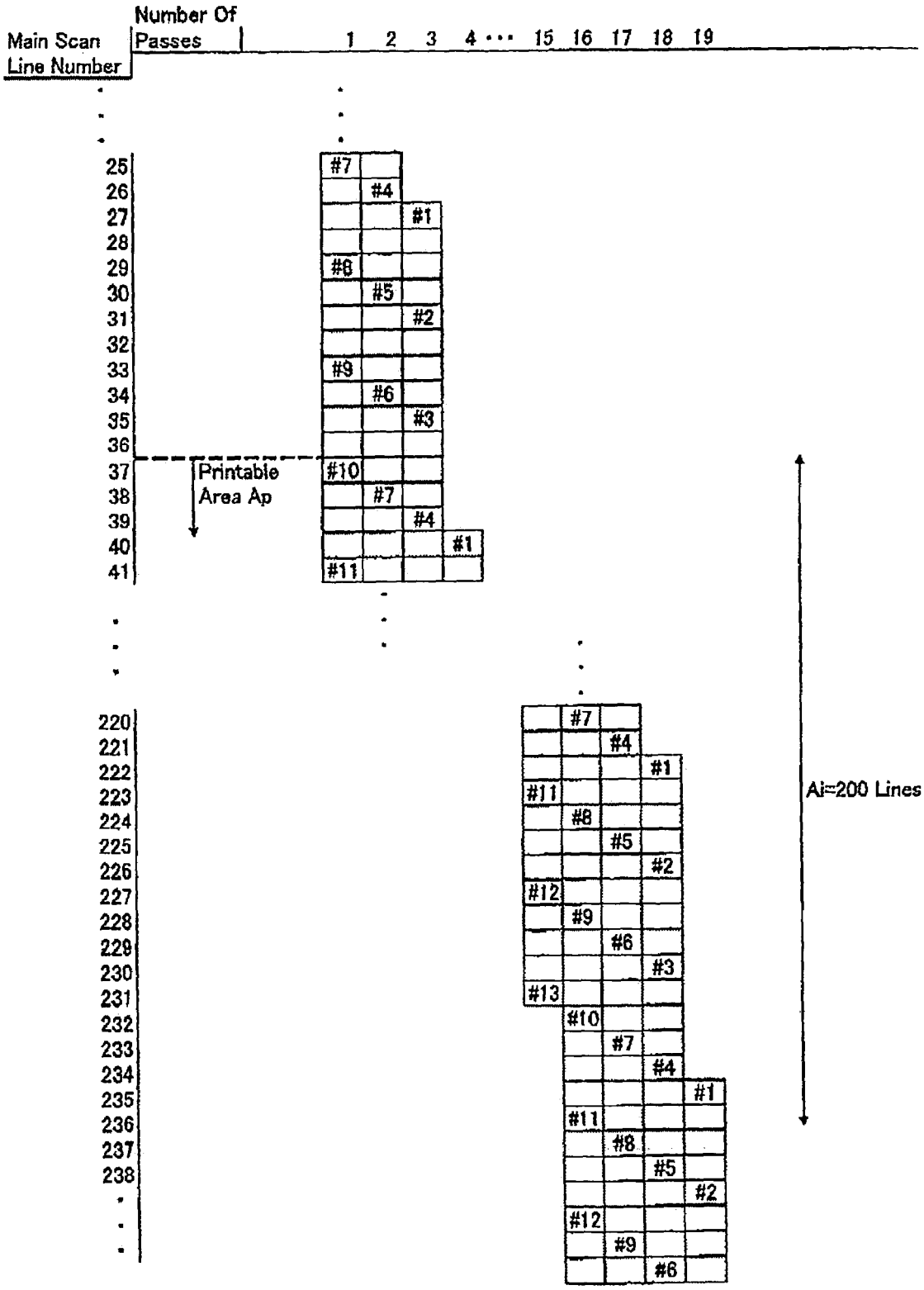
FIG. 7 is an illustration of how images with a range of 200 dots in the sub-scanning direction are printed in high speed mode.

FIG. 7 illustrates how an image Img2 with a range of 200 dots in the sub-scanning direction is printed in high speed mode. The symbols in the figure are the same as those in FIG. 4. In this case, the main scan line at the top end of the image Img2 is located at the $37^{th}$ line at the top end of the printable area Ap. The image Img is thus printed in 200 lines from the $37^{th}$ line to the $236^{th}$ line. The area where the image Img2 is printed is Ai in FIG. 7. As is evident in FIG. 7, the printed image is finished when the $235^{th}$ line is printed by nozzle #1 in the $19^{th}$ scan during printing in high speed mode. That is, an image Img2 with a range of 200 dots in the sub-scanning direction is printed in 19 passes in high speed mode.

Figure 8:
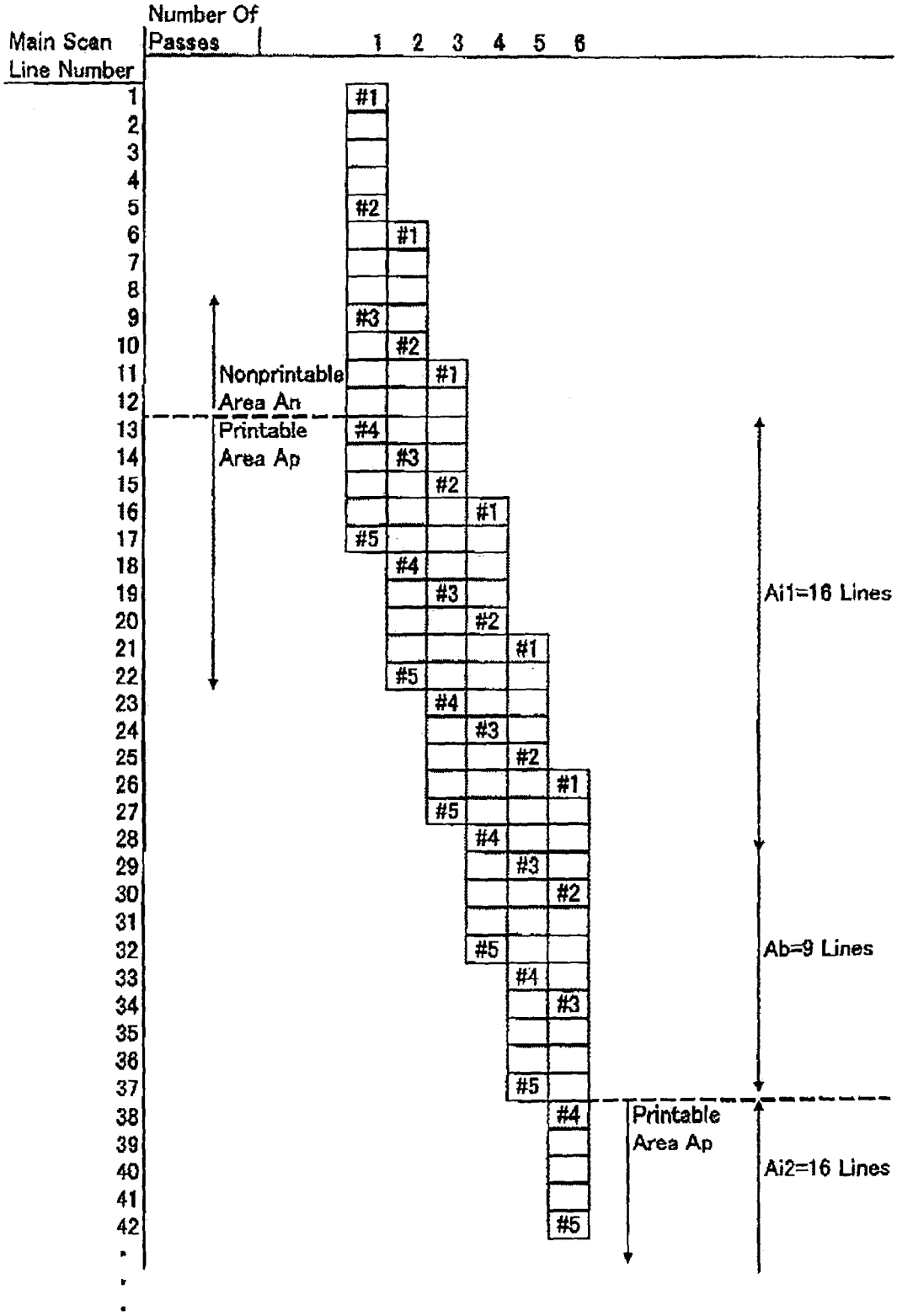
FIG. 8 is an illustration of how the main scan lines are printed by which nozzles in paper conserving mode.

(2) Paper Conserving Mode: FIG. 8 illustrates which nozzles the main scan lines are printed by in paper conserving modem. The symbols in the figure are the same as those in FIG. 4. As is evident in FIG. 8, in paper conserving mode, five nozzles (nozzles #1 through #5) are used for sub-scanning feed in 5 dot increments during printing. Nozzles #6 through #13 which are not used for printing are not indicated in FIG. 8. Printing in paper conserving mode is the printing in "second printing mode".

The nozzles do not go past the $12^{th}$, $7^{th}$, and $8^{th}$ lines, etc. in FIG. 8 during main scanning. Thus, in this example, the area at the $12^{th}$ line and above is not used for printing images. The main scan lines used to print images in this example are the $13^{th}$ scan lines and below from the upstream end in the sub-scanning direction among the main scan lines in which the nozzles on the printing head 28 can print dots partially.

When an image Img with a range of 16 dots is printed in the sub-scanning direction, for example, in paper conserving mode, the main scan line at the top of the image Img is located in the $13^{th}$ line at the top end of the printable area Ap. the image Img is thus printed in 16 lines, from the 13 to the $28^{th}$ lines.

As shown in FIG. 8, dots are printed in all the main scan lines included in the range Ai1 when main scanning is done 6 times in paper conserving mode. After the sixth main scan line is finished, nozzle #1 is at the $26^{th}$ line position as illustrated in FIG. 8.

The following is a case in which another image is printed after the image Img has been printed in the range Ai1. As is evident from FIG. 8, the printable area Ap is the area of the main scan line where nozzle #4 is located, and the area below, where the standard is the corresponding position of the nozzle row at the start of printing. As such, after the first image has been printed, and the next image is to be printed, the area where the image can be printed is the main scan line where nozzle #4 is located at that time and the area below. That is, it is the area of the $38^{th}$ line and below in FIG. 8. The next image is accordingly printed in 16 lines, from the $38^{th}$ line to the $53^{rd}$ line. A 9-line blank area is between the bottom end of area Ai1 where the first image is printed and the tope end of the area Ai2 where the next image is printed. Thus, when images Img with a range of 16 dots in the sub-scanning direction are printed multiple times in paper conserving mode, a 9-line blank area is put between each image.

Figure 9:
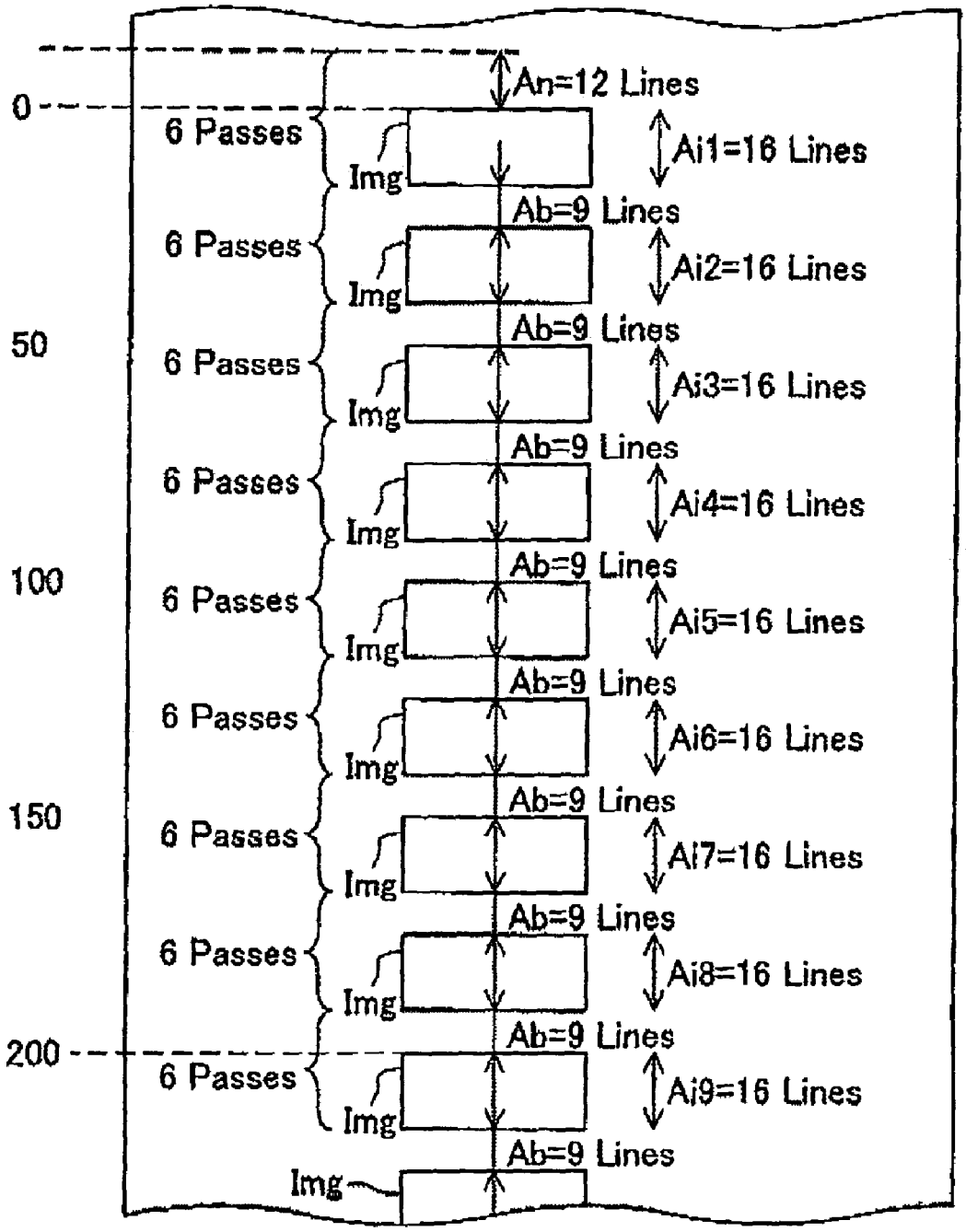
FIG. 9 is an illustration of the effects of printing when images with a range of 16 dots in the sub-scanning direction are repeatedly printed in paper conserving mode.

FIG. 9 illustrates the results of printing when images with a range of 16 dots in the sub-scanning direction are printed multiple times in paper conserving mode. In FIG. 9, the areas where images Img are printed are designated Ai1 through Ai9. Each image Img is printed with a 9-line blank area Ab between them. As a result, eight images Img are printed in zones with a range of 200 lines in the sub-scanning direction. Each image Img is printed in six passes (see FIG. 8).

Figure 10:
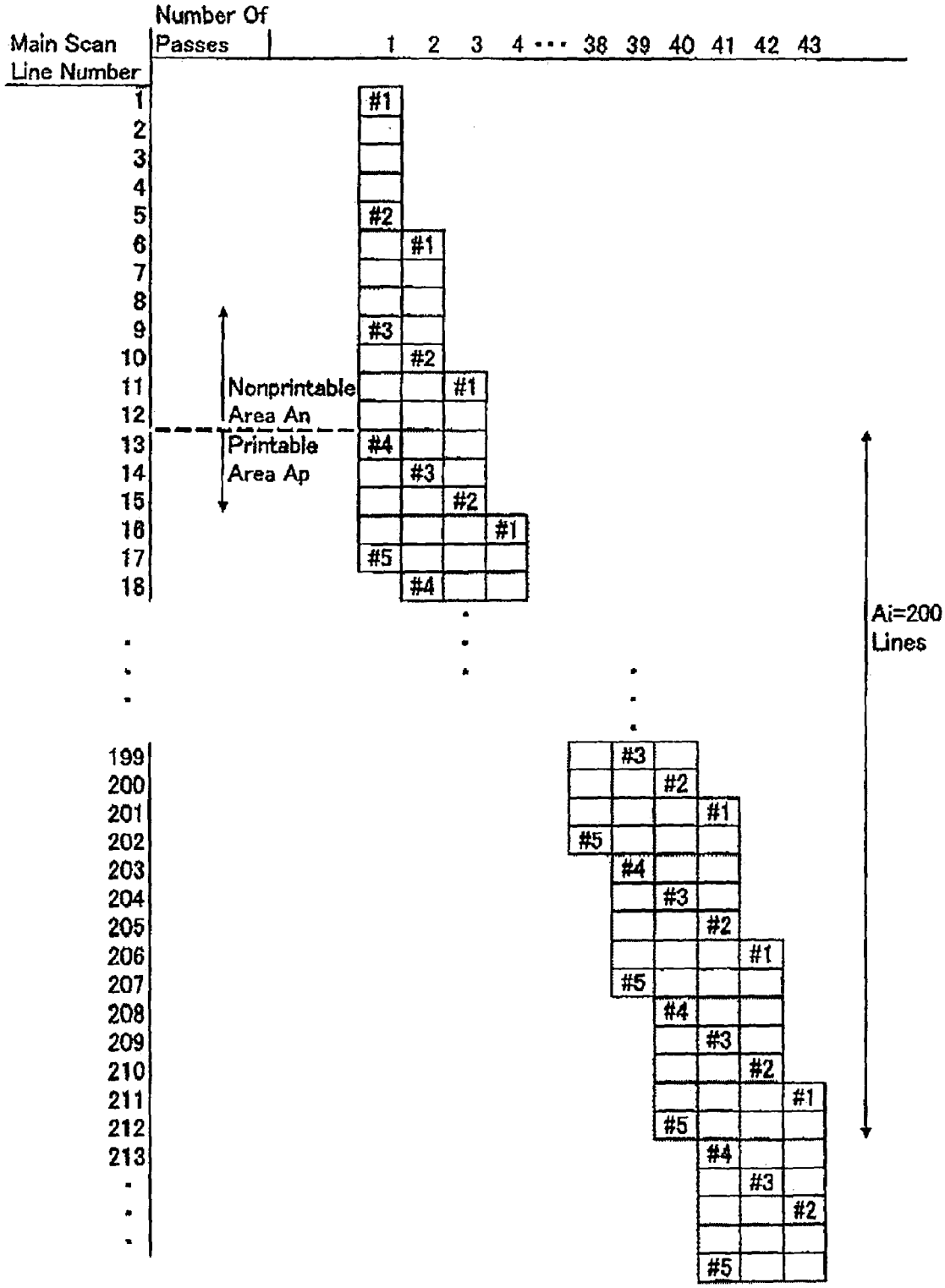
FIG. 10 is an illustration of how images with a range of 200 dots in the sub-scanning direction are printed in paper conserving mode.

FIG. 10 illustrates how an image Img2 with a range of 200 dots in the sub-scanning direction is printed in paper conserving mode. In this case, the main scan line at the top end of the image Img2 is located at the $13^{th}$ line at the top end of the printable area Ap. The image Img is thus printed in 200 lines from the $13^{th}$ line to the $212^{th}$ line. The area where the image Imq2 is printed is Ai in FIG. 10. As is evident in FIG. 10, the printed image is finished when the $211^{th}$ line is printed by nozzle #1 in the $43^{rd}$ scan during printing in paper conserving mode. That is, an image Img2 with a range of 200 dots in the sub-scanning direction is printed in 43 passes in paper conserving mode.

FIG. 11 is a table comparing high speed mode and paper conserving mode. In high speed mode, when images with a range of 16 lines are printed, the images are printed on print paper with 23-line blank areas between them (see FIG. 6). As such, the proportion of area in which images can be printed in the sub-scanning direction (referred to below as "printable percentage") is obtained by (16 lines)/(23+16) lines. The printable percentage in high speed mode is 41.0%. By contrast, in paper conserving mode, images are printed on print paper in areas having a range of 16 lines, with 9-line blank areas between them (see FIG. 9). As such, the printable percentage in paper conserving mode is obtained by (16 lines)/(9+16) lines, resulting in a printable percentage of 64.0%. The printable percentage is therefore greater in paper conserving mode. That is, images can be printed on printing paper more efficiently in paper conserving mode than in high speed mode.

Meanwhile, when images with a range of 16 lines are printed, the number of passes needed to print one image is 6 passes in paper conserving mode, compared to 4 passes in high speed mode. Thus, in general, then the same number of images Img are printed on rolled paper, images printed in high speed mode can be finished in ⅔ of the time it takes in paper conserving mode. Also, when images with a range of 200 lines are printed, printing in high speed mode can be finished in 19 passes (see FIG. 7). By contrast, it takes 43 passes to finish printing in paper conserving mode (see FIG. 10). Images are thus printed more rapidly in high speed mode than in paper conserving mode.

Figure 12:
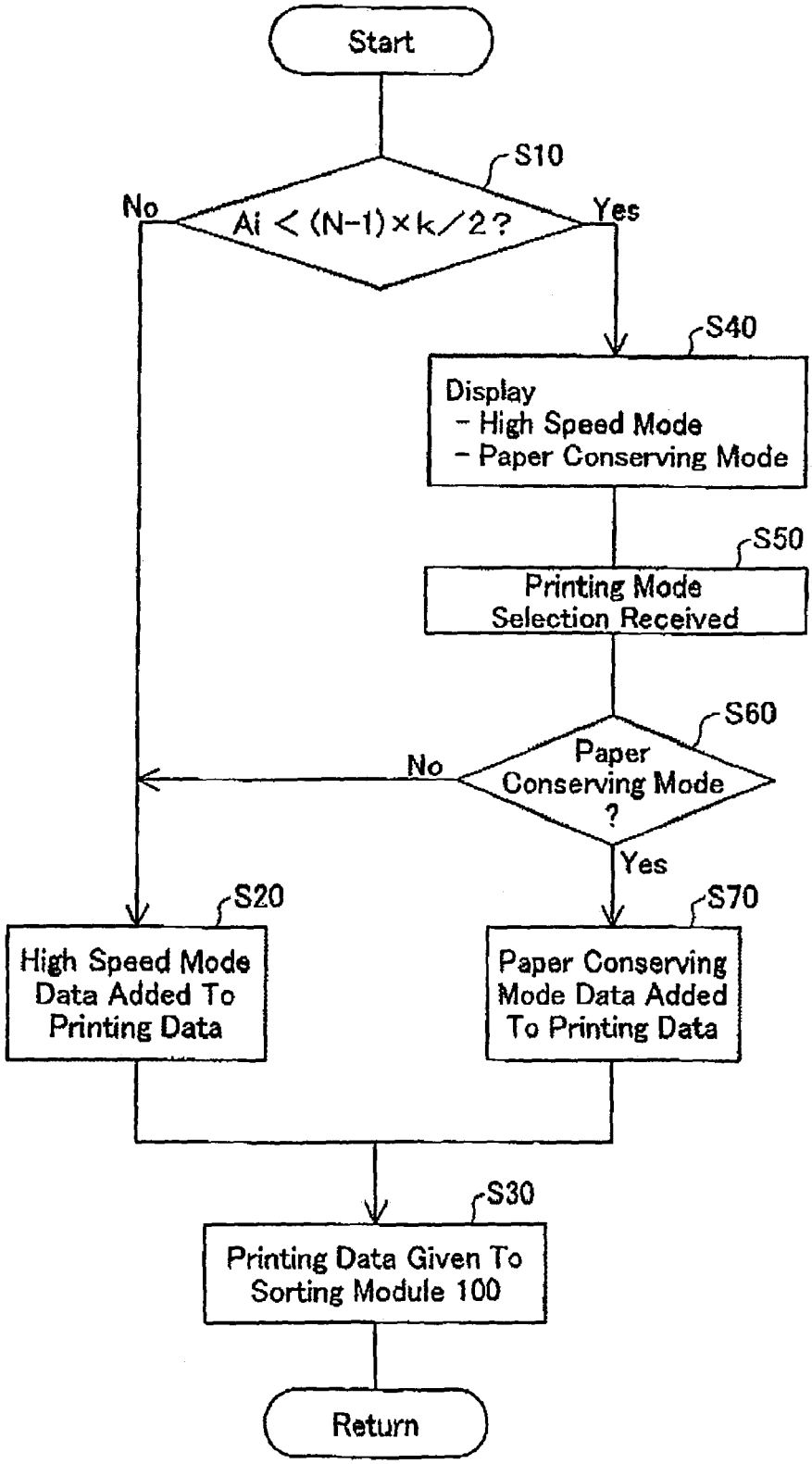
FIG. 12 is a flow chart showing the procedure for determining printing mode.

(3) Determining Printing Mode: FIG. 12 is a flow chart of the procedure by which the mode determining module 101 determines the printing mode. When the mode determining module 101 received printing data from the half tone module 99, it is determined whether the size Ai of the image data in the sub-scanning direction is smaller than $\{(N-1)\times k/2\}$ in Step S10. Here, N is the number of nozzles disposed at different locations in the sub-scanning direction, being nozzles that eject the same ink. In this example, N is 13. The symbol k is the nozzle pitch, expressed as the number of dots. In this example, k is 4. Ai is the value when the size of the image data in the sub-scanning direction is expressed as dots.

When Ai is equal to or greater than $\{(N-1)\times k/2\}$ in Step S10, the mode determining module 101 adds data indicating high speed mode, in Step S20, to the image data received from the half tone module 99. In Step S30, the image data is sent to the sorting module 100.

On the other hand, if Ap is less than $\{(N-1)\times k/2\}$ in Step S10, the mode determining module 101 displays a choice of "high speed mode" and "paper conserving mode" on a CRT 21 in Step S40. The user uses a mouse 13 or keyboard 14 to enter the selection to the computer 90. The mode determining module 101 receives the selected printing mode in Step S50, and determines whether or not the mode is paper conserving mode in Step S60. When the user selects high speed mode, the process advances to Step S20. The process in the subsequent steps S20 and S30 are the same as above.

When the user selects paper conserving mode in Step S60, data indicating paper conserving mode is added, in Step S70, to the received data. In Step S30, the printing data is sent to the sorting module 100.

The sorting module 100 receives the printing data including the printing mode data, and sorts the data according to the sequence in which it is to be sent to the printer 22 while referencing the printing mode table PMT. The printing mode table PMT has parameters such as the nozzles used and the sub-scanning feed for each printing mode. The sorting module 100 sorts the printing data according to the sequence in which the data is to be sent to the printer 22 as befits the printing mode while referencing these parameters. The printer 22 prints in high speed mode when it receives data sorted for high speed mode by the sorting module 100 (see FIGS. 4 and 5). When data sorted for paper conserving mode by the sorting module 100 is received, it is printed in paper conserving mode (see FIG. 8).

In this example, when the image is larger than the predetermined criteria, it is printed in high speed mode. Large images can thus be printed sooner. When the image is smaller than the predetermined criteria, the user can also select high speed mode or paper conserving mode. When paper conserving mode is selected, images can be printed more efficiently on the printing paper.

B. SECOND EXAMPLE

In the printing device of the second example, images can be printed in divided mode in addition to printing in high speed and paper conserving modes. High speed mode it the same as in the first example, but the number of nozzles used and the feed in paper conserving mode are different than in the first example. All other points are the same as the printing device in the first example.

Figure 13:
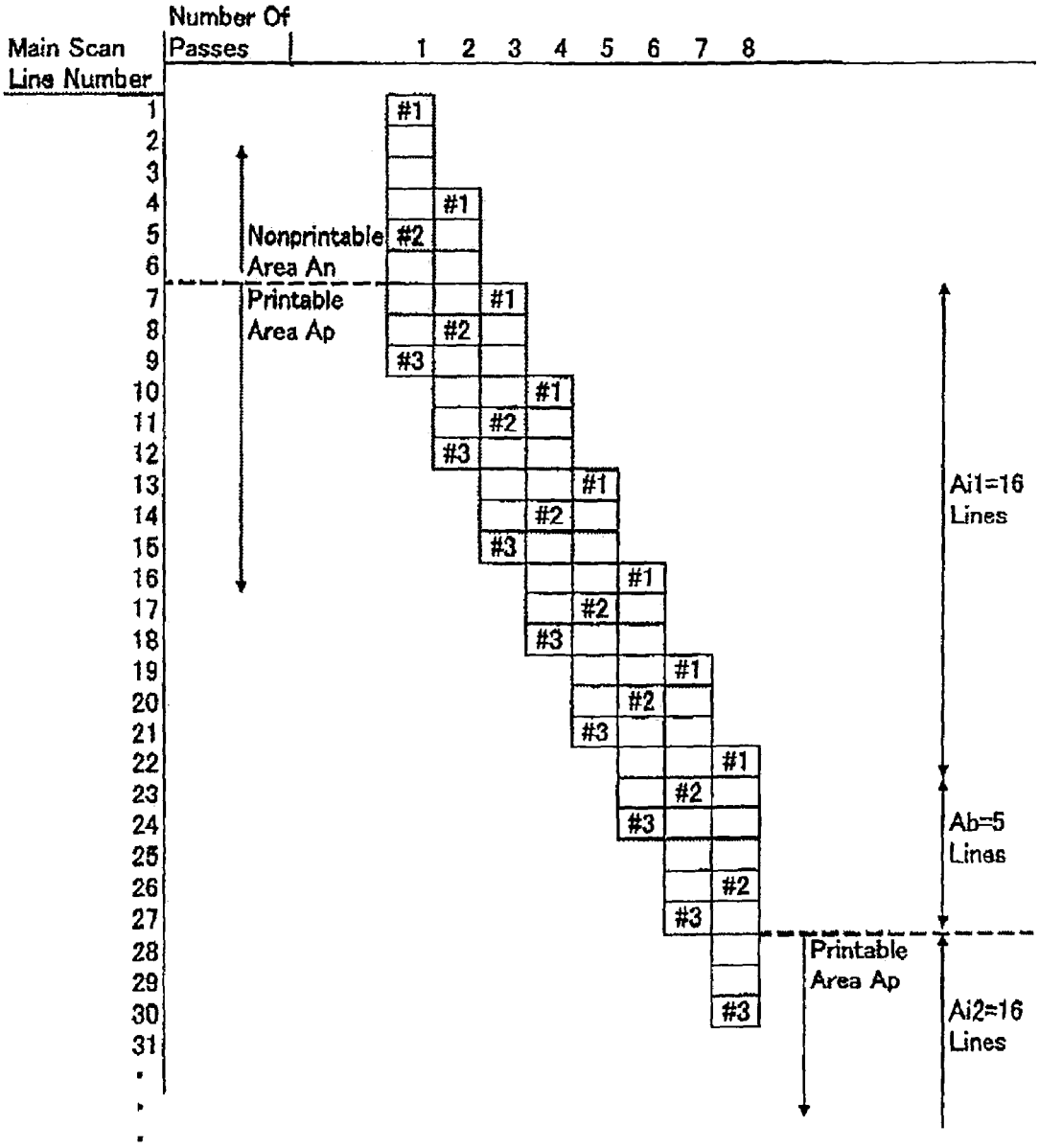
FIG. 13 is an illustration of how the main scan lines are printed by which nozzles in paper conserving mode.

(1) Paper Conserving Mode: FIG. 13 illustrates how the main scan lines are printed by which nozzles in paper conserving mode. The symbols in the figure are the same as in FIG. 4, As is evident in FIG. 13, in paper conserving mode in the second example, three nozzles (nozzles #1 through #3) are used in printing for sub-scanning feed 3 dots at a time. In this type of printing, the printable area Ap is the area equal to 2 lines below nozzle #2 (of the printing nozzle row at the start of printing) and the area below. As a result, when images with a range of 16 lines in the sub-scanning direction are printed multiple times, 5-line blank areas Ab are put between each image. Each image Img is also printed in 8 passes.

Figure 14:
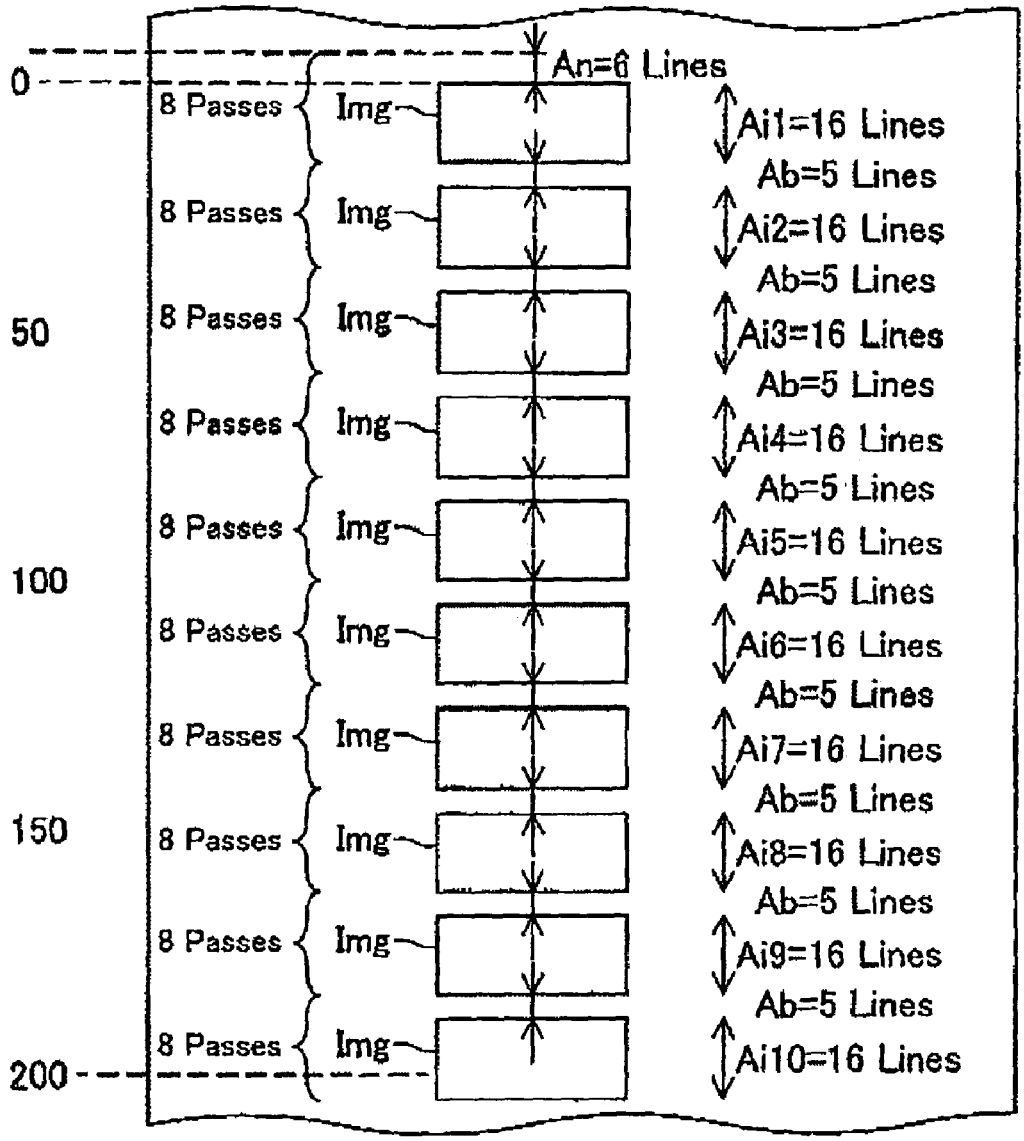
FIG. 14 is an illustration of the effects of printing when images with a range of 16 dots in the sub-scanning direction are repeatedly printed in paper conserving mode in the second example.

FIG. 14 illustrates the results of printing when images with a range of 16 dots in the sub-scanning direction are printed multiple times in paper conserving mode in the second example. In FIG. 14, the areas where images Img are printed are designated Ai1 through Ai10. Each image Img is printed with a 5-line blank area Ab between them. As a result, nine images Img are printed in zones with a range of 200 lines in the sub-scanning direction.

Figure 15:
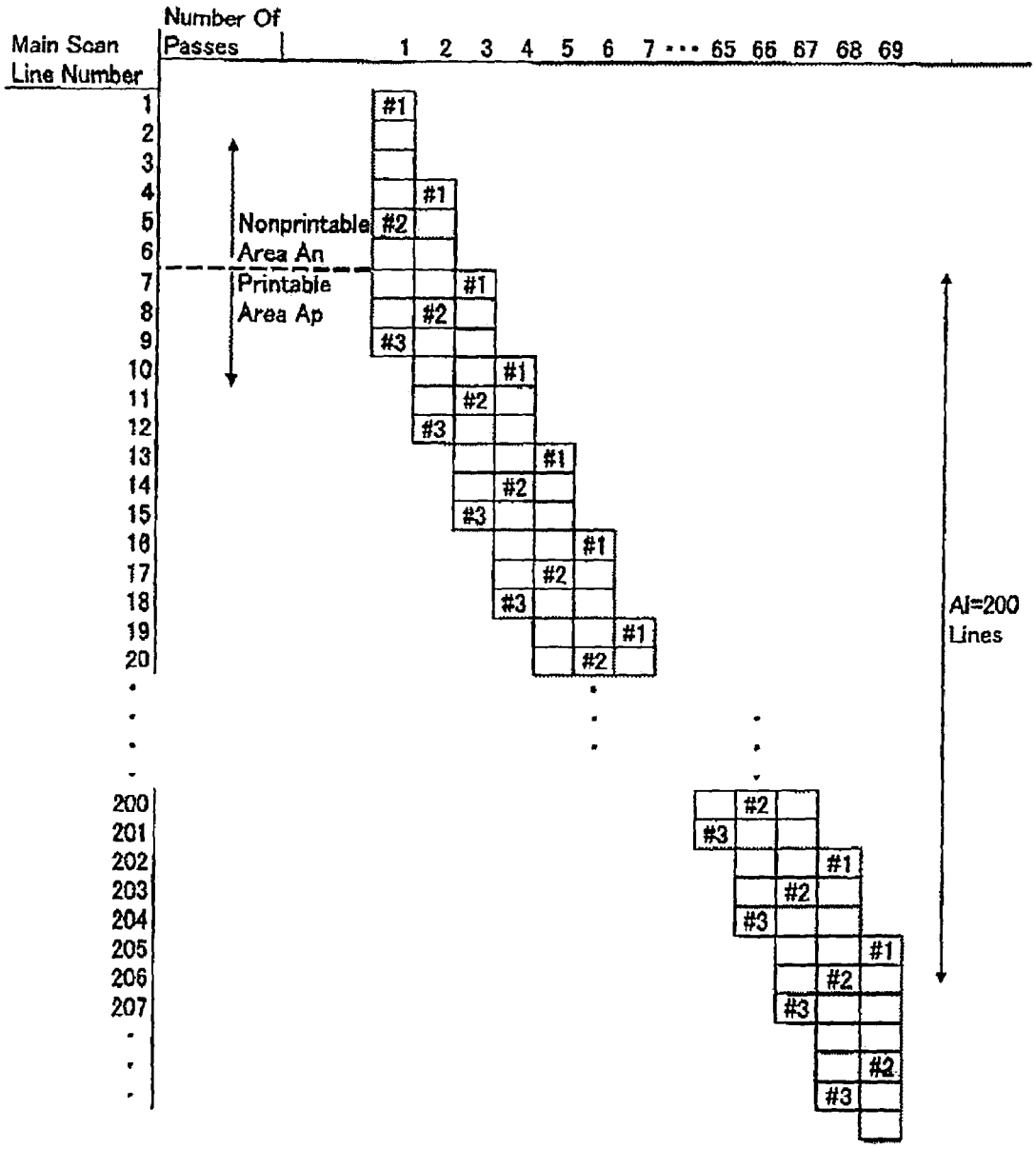
FIG. 15 is an illustration of how images with a range of 200 dots in the sub-scanning direction are printed in paper conserving mode in the second example.

FIG. 15 illustrates how an image Img2 with a range of 200 dots in the sub-scanning direction is printed in paper conserving mode in the second example. The image Img is printed in 200 lines from the $7^{th}$ line to the $206^{th}$ line. As is evident in FIG. 15, the printed image is finished when the $206^{th}$ line is printed by nozzle #1 in the $69^{th}$ scan during printing in paper conserving mode in the second example. That is, an image Img2 with a range of 200 dots in the sub-scanning direction is printed in 69 passes in paper conserving mode in the second example.

Figure 16:
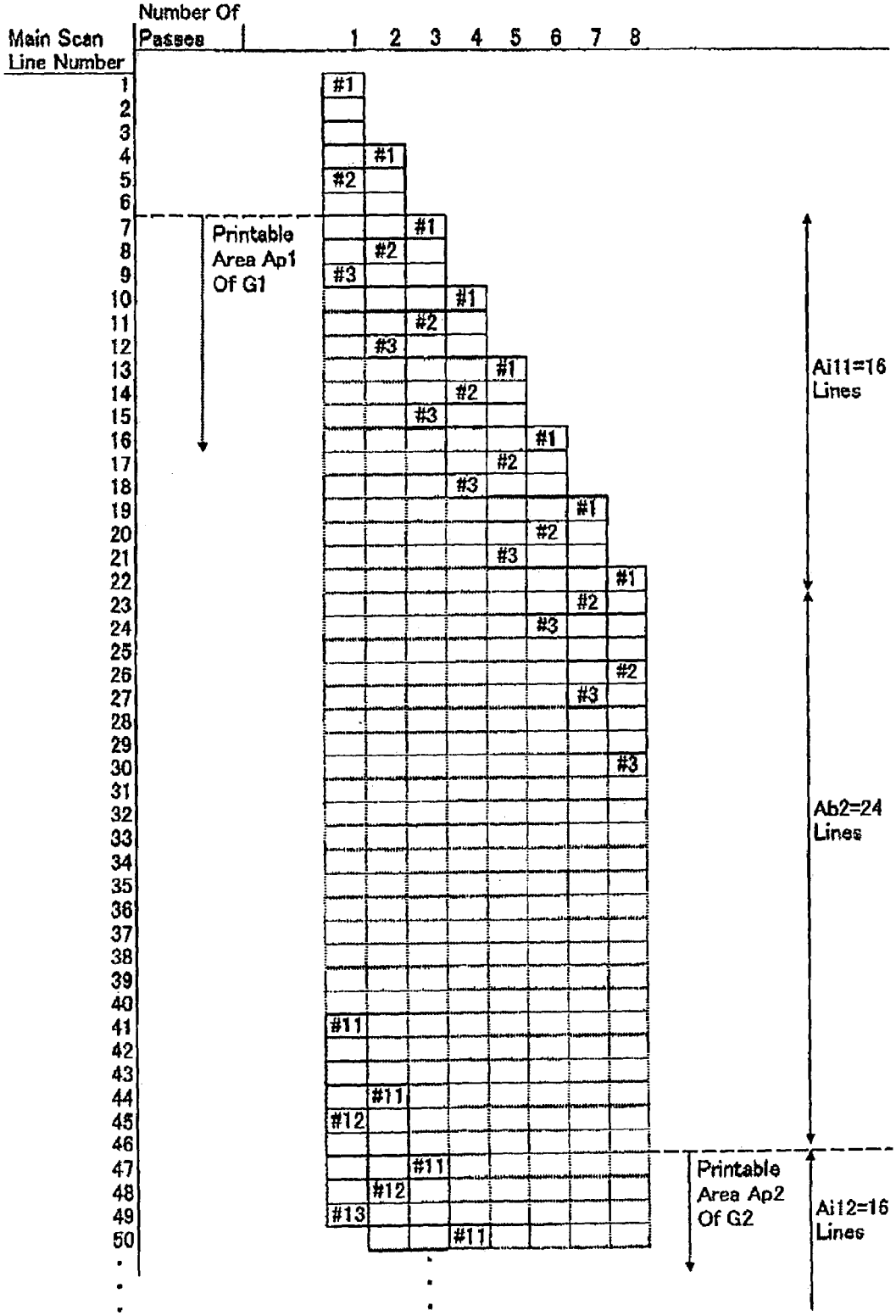
FIG. 16 is an illustration of the effects of printing is when two images with a range of 16 dots in the sub-scanning direction are printed in divided mode in the second example.
Figure 17:
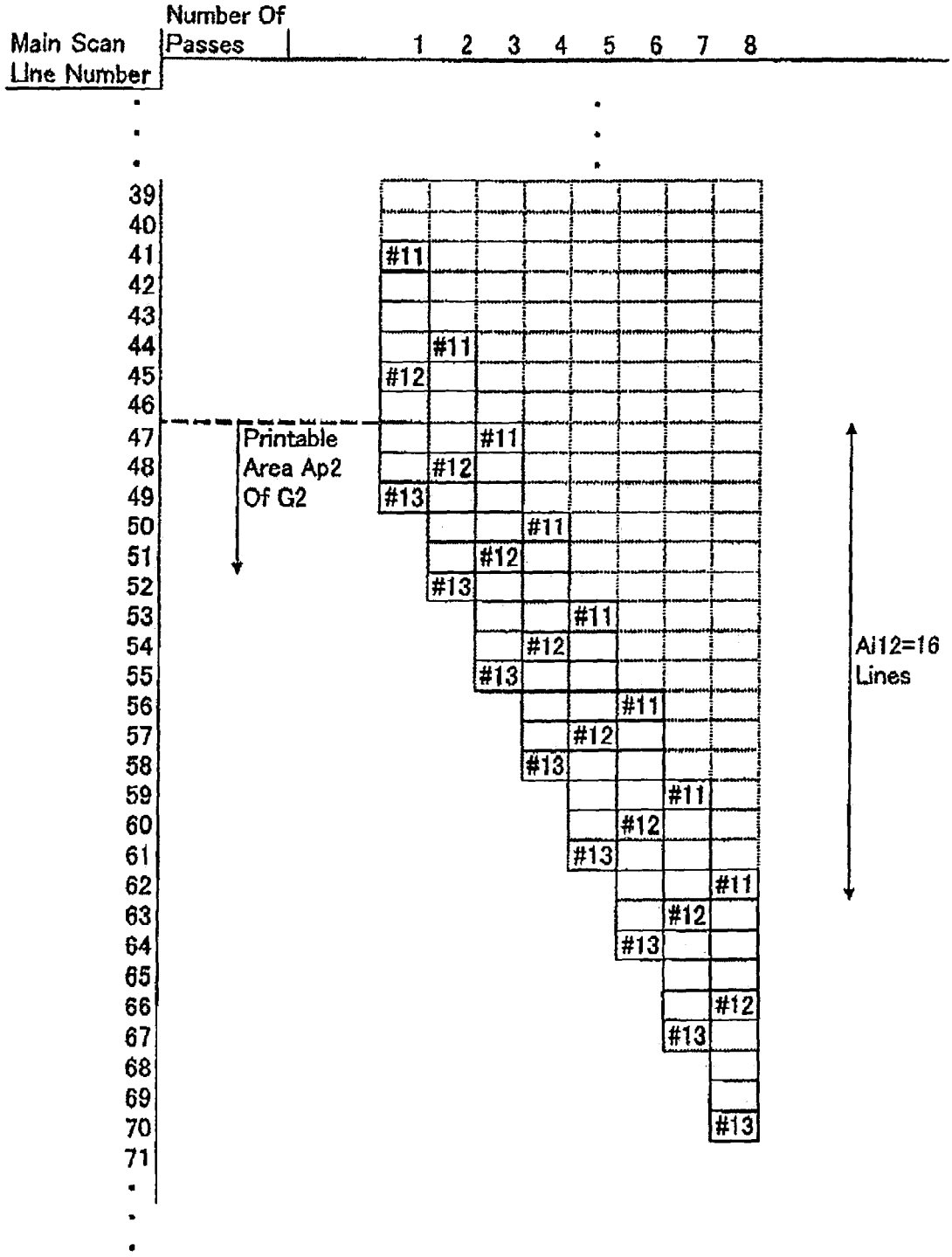
FIG. 17 is an illustration of the effects of printing when two images with a range of 200 dots in the sub-scanning direction are printed in divided mode in the second example.
Figure 19:
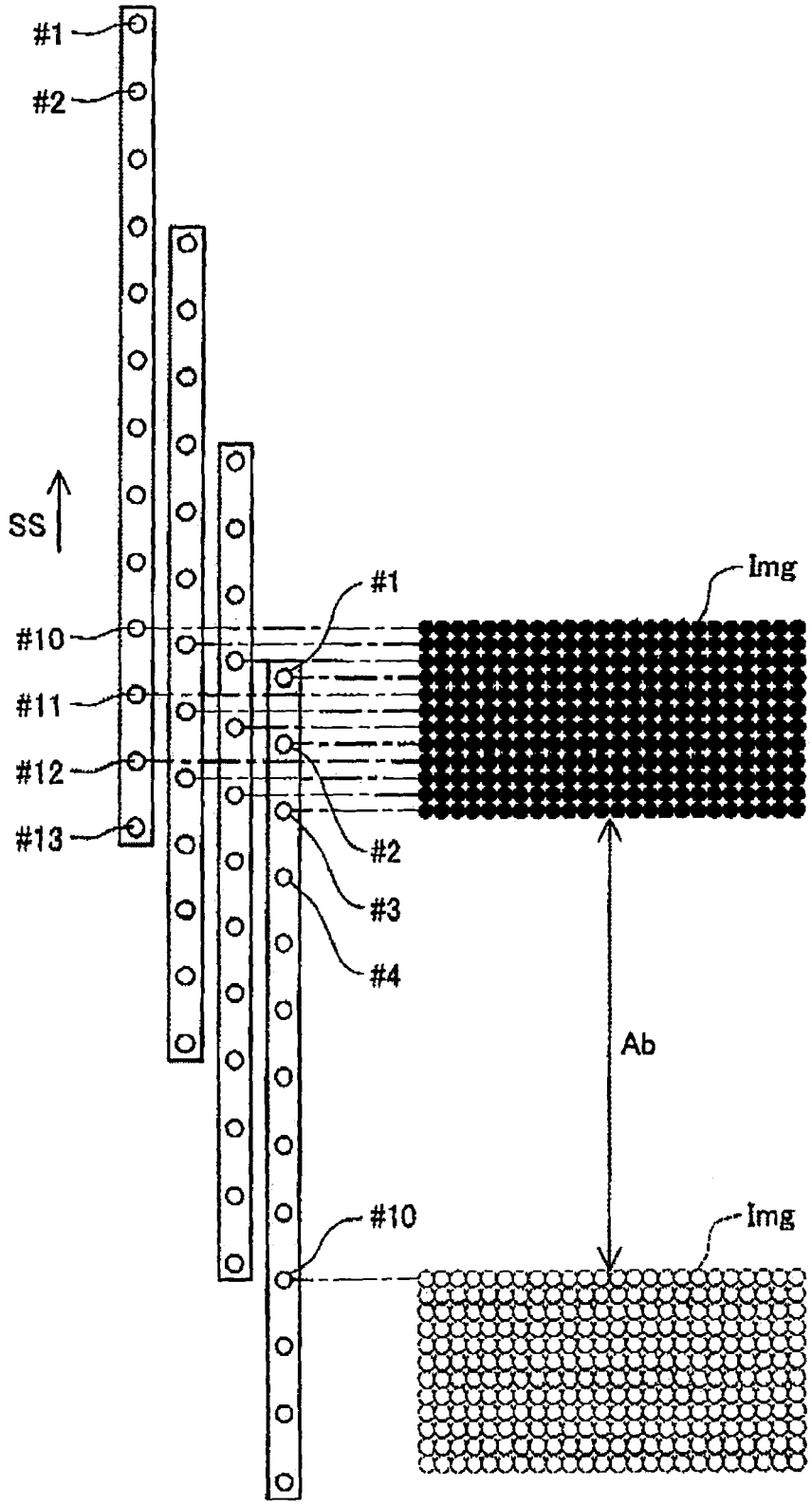
FIG. 19 is an illustration of an example of interlace printing.

(2) Divided mode: FIGS. 16 and 17 illustrate the results of printing when two copies of an image with a range of 16 dots in the sub-scanning direction are printed in divided mode in the second example. Nozzles #1 through #3 located relatively downstream in the sub-scanning direction and nozzles #11 through #13 located relatively upstream in the sub-scanning direction are used in divided mode. The sub-scanning feed is 3 dots. Divided mode is run when the size of the image in the sub-scanning direction is smaller than the predetermined criteria. The criteria is lower than the criteria $\{(N-1)\times k/2\}$ for determining whether to run paper conserving mode.

In divided mode, nozzles #1 through #3 (referred to below as nozzle group G1) and nozzles #11 through #13 (referred to below as nozzle group G2) each print one copy of an mage with a range of 16 dots in the sub-scanning direction. As a result, a total of two images with a range of 16 dots in the sub-scanning direction are printed on the upstream and downstream sides in 8 passes in divided mode. The areas were the images are printed are Ai11 and Ai12, respectively. The image in area Ai11 is printed only by nozzle group G1, and the image in area Ai12 is printed only by nozzle group G2. As is evident in FIGS. 16 and 17, each nozzle group forms dots on the printing paper in each of the first to eighth passes. Nozzle group G1 corresponds to the "second use dot-forming element group", and nozzle group G2 corresponds to the "first-use dot-forming element group".

The printable area Ap1 of the nozzle group G1 consisting of nozzles #1 through #3 is the area equal to 2 lines below nozzle #2 (at the start of printing) and the area below. The printable area Ap2 of the nozzle group G2 consisting of nozzles #11 through #13 is the area equal to 2 lines below nozzle #12 (at the start of printing) and the area below. As a result, two images are printed with a 24-line blank area Ab2 between them, as shown in FIG. 16.

FIG. 18 is a table comparing high speed mode, paper conserving mode, and divided mode. The printable percentage in high speed mode when images with a range of 16 lines are printed is 41.0%, as shown in the first example. On the other hand, in paper conserving mode in the second example, images are printed on print paper in areas having a range of 16 lines, with 5-line blank areas between them (see FIG. 14). As such, the printable percentage in paper conserving mode is obtained by (16 lines)/(5+16) lines, resulting in a printable percentage of 76.2%. The printable percentage is therefore higher in paper conserving mode. That is, images can be printed on printing paper more efficiently in paper conserving mode than in high speed mode.

Meanwhile, when images with a range of 16 lines are printed, the number of passes needed to print one image is 8 passes in paper conserving mode, compared to 4 passes in high speed mode. Also, when images with a range of 200 lines are printed, printing in high speed mode can be finished in 19 passes (see FIG. 7) By contrast, it takes 69 passes to finish printing in paper conserving mode (see FIG. 15). Images are thus printed more rapidly in high speed mode than in paper conserving mode.

Furthermore, when images with a range of 16 lines are printed in twos, the number of passes needed for printing (total number of processed passes) is 8 passes in high speed mode, 16 passes in paper conserving mode, and 8 passes in divided mode. Images can thus be printed more rapidly in divided mode in this case. The total sub-scanning feed (overall feed) during printing of images in twos is 39 dots in high speed mode, 42 dots in paper conserving mode, and 21 dots in divided mode. That is, the overall feed is lowest in divided mode. Thus, in divided mode, the extent to which sub-scanning feed errors are reflected in the results of printing are lower and the print quality is higher.

C. VARIANTS

The invention is not limited to the above examples and embodiments, and is capable of various modifications within the scope thereof. The following are examples of possible variants.

C1: Variant 1

In the above examples, the sub-scanning feed was constant in the various printing modes. However, sub-scanning can be done according to a combination of different feeds. For example, 13 dot, 15 dot, 9 dot, 11 dot, and 17 dot feeds can be repeatedly combined in high speed mode using 13 nozzles, 7 dot, 3 dot, and 5 dot feeds can be repeatedly combined in paper conserving mode using 5 nozzles. That is, there may be a plurality of modes with different average feeds. It is also possible to have a plurality of modes with different maximum feeds. The ratio of the average of the feed in each mode may be equivalent to the ratio of the number of nozzles used in each mode. This will permit the print quality to be closer in each mode.

Sub-scanning may also be done at a constant feed in one printing mode, and a plurality of feeds can be repeatedly combined in other printing modes. Moreover, when sub-scanning is done at a constant feed, it is preferable that the feed and the nozzle pitch when expressed in the number of dots are mutually prime.

In another possible embodiment, a fixed pattern feed is not done repeatedly in divided mode. That is, the feed can be set so that a prescribed area can be printed without gaps in the sub-scanning direction by the nozzles of each nozzle group. An example of such printing is one in which several sub-scans after the start of printing and several sub-scans before the end of printing are done with feeds lower than that of the sub-scans between. This will allow large images to be printed in divided mode. Areas in which each group can print may also overlap.

In the second example above, divided mode was prepared as a third mode in addition to high speed mode and paper conserving mode. However, another possible embodiment of the printing device can have two modes: a high speed mode and a divided mode. That is, the printing device can have the two following modes. The first printing mode can be a printing mode in which, when relatively large images in the sub-scanning direction are printed, a relatively large number of dot-forming elements from among the plurality of dot-forming elements can be used to form dots through sub-scanning with a relatively large average feed. The second printing mode can be a printing mode in which, when a plurality of relatively small images in the sub-scanning direction are printed at different locations in the sub-scanning direction on the same print medium, a relatively small number of dot-forming elements are used from among the plurality of dot-forming elements to form dots by sub-scanning with a relatively low average feed.

C2: Variant 2

In the above examples, the print medium was a roll of paper, but the print medium can be other materials, such as fabric or resin sheets. The print medium is not limited to those wound around a spool, and can be in other configurations and embodiments. However, this printing device is particularly effective in cases where the dimensions in the sub-scanning direction are at least 5 times the dimensions in the main scanning direction When set up in the printing device for printing. Furthermore, the dimensions in the sub-scanning direction relative to the dimensions in the main scanning direction are more preferably at least 10 times greater, and even more preferably at least 20 times greater.

The number of nozzles for each color is also not limited to 13 and can be other numbers. The number of nozzles used in paper saving mode and divided mode corresponding to the second printing mode can be a number other than 3 or 5. That is, the number of nozzles that are used may be lower than that used in high speed mode. In the first example, 5 nozzles were used in paper conserving mode. In the second example, 3 nozzles were used in paper conserving mode, and 6 were used in divided mode. The number of nozzles used in both cases was smaller than the 13 nozzles used in high speed mode. That is, high speed mode corresponds to the "first printing mode", while paper conserving mode and divided mode correspond to the "second printing mode".

C3: Variant 3

The invention is also applicable to drum scan printers. The invention may be used not only with what are referred to as ink jet printers, but can be applied in general to printing devices which print images by forming dots from printing heads. Dot impact printers are an example of such printing devices.

C4: Variant 4

In the above examples, some of the components realized by means of hardware may be replaced with software, and vice versa. For example, part of the function of CPU 41 (FIG. 2) can be run by the computer 90.

Computer programs for executing such functions may be provided in a form where they have been recorded on computer-readable media, such as floppy disks and CD-ROM. The computer 90 reads the computer program from such media and transmits it to an internal memory device or external memory devices. Alternatively, computer programs may be supplied to the computer 90 from a program provides through a communications route. When the computer program functions are executed, computer programs stored in internal memory devices can be run by a microprocessor in the computer 90. Computer programs recorded on recording media may also be run directly by the computer 90.

As used in the present Specification, the computer 90 is a concept that includes hardware devices and an operating system, and means a hardware device that operates under the control of the operating system. The computer program allows the computer to execute the functions of the various parts above. Some of the above functions may be realized by the operating system rather than an application program.

The computer program product may be realized as many aspects. For example:

(i) Computer readable medium, for example the flexible disks, the optical disk, or the semiconductor memories;

(ii) Data signals, which comprise a computer program and are embodied inside a carrier wave;

(iii) Computer including the computer readable medium, for example the magnetic disks or the semiconductor memories; and (iv) Computer temporally storing the computer program in the memory through the data transferring means.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing method for printing images by printing dots on a print medium, comprising:

(a) selecting a printing mode; and (b) printing the images according to the selected mode;

wherein:

the step (b) includes:

executing main scanning by moving at least one of a dot printing head and a print medium; and executing sub-scanning by moving the print medium in a direction perpendicular to a direction of the main scanning between the main scannings, and the step (a) includes selecting one of:

a first printing mode wherein, in the first printing mode, a relatively large image in a direction of the sub-scanning is printed based on first image data, and a relatively large number of dot-forming elements are used to form dots and a sub-scanning with a relatively large average feed are executed, and a second printing mode wherein, in the second printing mode, a plurality of relatively small images in the direction of the sub-scanning are printed based on second image data, and a relatively small number of dot-forming elements are used to form dots and a sub-scanning with a relatively small average feed are executed.

2. The printing method according to claim 1, wherein:

the sub-scanning is executed with a relatively large fixed first feed in the first printing mode; and the sub-scanning is executed with a relatively low fixed second feed in the second printing mode.

3. The printing method according to claim 1, wherein:

the sub-scanning is executed repeatedly with a combination of a plurality of feeds in the first printing mode, an average of the plurality of feeds in the first printing mode being relatively large; and the sub-scanning is executed repeatedly with a combination of a plurality of feeds in the second printing mode, an average of the plurality of feeds in the second printing mode being relatively low.

4. The printing method according to claim 3, wherein the plurality of feeds in the first printing mode comprise at least two feeds of different amounts.

5. The printing method according to claim 4, wherein the plurality of feeds in the second printing mode comprise at least two feeds of different amounts.

6. The printing method according to claim 3, wherein the plurality of feeds in the second printing mode comprise at least two feeds of different amounts.

7. The printing method according to claim 1, wherein the relatively large image or the plurality of relatively small images are printed in substantially the same printing area of the print medium, regardless of whether the first printing mode or the second printing mode is selected.

8. A printing method for printing an image by printing dots on a print medium, comprising:

(a) selecting a printing mode; and (b) printing the image according to the selected mode;

wherein:

the step (b) includes:

executing main scanning by moving at least one of a dot printing head and a print medium; and executing sub-scanning by moving the print medium in a direction perpendicular to a direction of the main scanning between the main scannings, and the step (a) includes selecting one of:

a first printing mode wherein, when a relatively large image in a direction of the sub-scanning is to be printed, a relatively large number of dot-forming elements are used to form dots and a sub-scanning with a relatively large average feed are executed, and a second printing mode wherein, when a relatively small images in the direction of the sub-scanning is to be printed, a relatively small number of dot-forming elements are used to form dots and a sub-scanning with a relatively small average feed are executed, wherein the step (b) further comprises, in the second printing mode, printing dots with a first-use dot-forming element group and a second-use dot-forming element group during a same main scanning to print first and second images, the first-use dot-forming element group comprising dot-forming elements in a relatively upstream range in the direction of the sub-scanning, and the second-use dot-forming element group comprising dot-forming elements in a relatively downstream range in the direction of the sub-scanning, wherein the first image is printed with the first-use dot-forming element group solely, and the second image is printed with the first-use dot-forming element group solely.

9. A dot printing device for printing images on a print medium, comprising:

a dot printing head having a plurality of dot-forming elements for forming dots on the print medium;

a main scanning driver for executing main scanning by moving at least one of the dot printing head and the print medium;

a head driver for driving at least some of the plurality of dot-forming elements to form dots during the main scanning;

a sub-scan driver for executing sub-scanning by moving the print medium in a direction perpendicular to a direction of the main scanning between the main scannings; and a control unit for controlling the main scanning driver, the head driver, and the sub-scan driver, the control unit comprising:

a first printing mode wherein, in the first printing mode, a relatively large image in a direction of the sub-scanning is printed based on first image data, and a relatively large number of dot-forming elements among the plurality of dot-forming elements are used to form dots and a sub-scanning with a relatively large average feed are executed; and a second printing mode wherein, in the second printing mode, a plurality of relatively small images in the direction of the sub-scanning are printed based on second image data, and a relatively small number of dot-forming elements among the plurality of dot-forming elements are used to form dots and a sub-scanning with a relatively small average feed are executed.

10. The printing device according to claim 9, wherein the relatively large image or the plurality of relatively small images are printed in substantially the same printing area of the print medium, regardless of whether the first printing mode or the second printing mode is selected.

11. A dot printing device for printing dots on a print medium, comprising:

a dot printing head having a plurality of dot-forming elements for forming dots on the print medium;

a main scanning driver for executing main scanning by moving at least one of the dot printing head and the print medium;

a head driver for driving at least some of the plurality of dot-forming elements to form dots during the main scanning;

a sub-scan driver for executing sub-scanning by moving the print medium in a direction perpendicular to a direction of the main scanning between the main scannings; and a control unit for controlling the main scanning driver, the head driver, and the sub-scan driver, the control unit comprising:

a first printing mode wherein, when a relatively large image in a direction of the sub-scanning is to be printed, a relatively large number of dot-forming elements among the plurality of dot-forming elements are used to form dots and a sub-scanning with a relatively large average feed are executed; and a second printing mode wherein, when a relatively small images in the direction of the sub-scanning is to be printed, a relatively small number of dot-forming elements among the plurality of dot-forming elements are used to form dots and a sub-scanning with a relatively small average feed are executed, wherein, in the second printing mode, dots are printed with a first-use dot-forming element group and a second-use dot-forming element group during a same main scanning to print first and second images, the first-use dot-forming element group comprising dot-forming elements in a relatively upstream range in the direction of the sub-scanning, and the second-use dot-forming element group comprising dot-forming elements in a relatively downstream range in the direction of the sub-scanning, wherein the first image is printed with the first-use dot-forming element group solely, and the second image is printed with the first-use dot-forming element group solely.

12. A print controller for generating print data of images to be supplied to a printing device having a plurality of dot-forming elements, comprising:

a first print data generator for generating first print data to allow the printing device to print in a first printing mode to form dots by sub-scanning with a relatively large average feed using a relatively large number of dot-forming elements when a relatively large image is to be printed based on the first print data in a direction of the sub-scanning; and a second print data generator for generating second print data to allow the printing device to print in the second printing mode to form dots by sub-scanning with a relatively low average feed using a relatively small number of dot-forming elements when a plurality of relatively small images are to be printed based on the second print data in the direction of the sub-scanning.

13. The print controller according to claim 12, wherein the relatively large image or the plurality of relatively small images are printed in substantially the same printing area of a print medium, regardless of whether the first printing mode or the second printing mode is selected.

14. A print controller for generating print data to be supplied to a printing device having a plurality of dot-forming elements, comprising:

a first print data generator for generating first print data to allow the printing device to print in a first printing mode to form dots by sub-scanning with a relatively large average feed using a relatively large number of dot-forming elements when a relatively large image is to be printed in a direction of the sub-scanning; and a second print data generator for generating second print data to allow the printing device to print in the second printing mode to form dots by sub-scanning with a relatively low average feed using a relatively small number of dot-forming elements when a relatively small image is to be printed in the direction of the sub-scanning, wherein:

the second print data generator generates the second print data to allow the printing device to print in the second printing mode to form dots with a first-use dot-forming element group and a second-use dot-forming element group during a same main scanning to print first and second images, the first-use dot-forming element group comprising dot-forming elements in a relatively upstream range in the direction of the sub-scanning, and the second-use dot-forming element group comprising dot-forming elements in a relatively downstream range in the direction of the sub-scanning, and the first image is printed with the first-use dot-forming element group solely, and the second image is printed with the first-use dot-forming element group solely.

15. A computer program product for printing images by printing dots on a print medium, the computer program product comprising:

a computer readable medium; and a computer program stored on the computer readable medium, the computer program comprising:

instructions for selecting a printing mode; and instructions for printing the images according to the selected mode;

wherein:

the instructions for printing the images include:

instructions for executing main scanning by moving at least one of a dot printing head and a print medium; and instructions for executing sub-scanning by moving the print medium in a direction perpendicular to a direction of the main scanning between the main scannings, and the instructions for selecting a printing mode include instructions for selecting one of:

a first printing mode wherein, in the first printing mode, a relatively large image in a direction of the sub-scanning is printed based on first image data, and a relatively large number of dot-forming elements are used to form dots and a sub-scanning with a relatively large average feed are executed, and a second printing mode wherein, in the second printing mode, a plurality of relatively small images in the direction of the sub-scanning are printed, and a relatively small number of dot-forming elements are used to form dots and a sub-scanning with a relatively small average feed are executed.

16. The computer program product according to claim 15, wherein the relatively large image or the plurality of relatively small images are printed in substantially the same printing area of the print medium, regardless of whether the first printing mode or the second printing mode is selected.

17. A computer program product for printing an image by printing dots on a print medium, the computer program product comprising:

a computer readable medium; and a computer program stored on the computer readable medium, the computer program comprising:

instructions for selecting a printing mode; and instructions for printing the image according to the selected mode;

wherein:

the instructions for printing the image include:

instructions for executing main scanning by moving at least one of a dot printing head and a print medium; and instructions for executing sub-scanning by moving the print medium in a direction perpendicular to a direction of the main scanning between the main scannings, and the instructions for selecting a printing mode include instructions for selecting one of:

a first printing mode wherein, when a relatively large image in a direction of the sub-scanning is to be printed, a relatively large number of dot-forming elements are used to form dots and a sub-scanning with a relatively large average feed are executed, and a second printing mode wherein, when a relatively small images in the direction of the sub-scanning is to be printed, a relatively small number of dot-forming elements are used to form dots and a sub-scanning with a relatively small average feed are executed, wherein the instructions for printing the image flirt her comprise instructions for printing dots with a first-use dot-forming element group and a second-use dot-forming element group during a same main scanning to print first and second images in the second printing mode, the first-use dot-forming element group comprising dot-forming elements in a relatively upstream range in the direction of the sub-scanning, and the second-use dot-forming element group comprising dot-forming elements in a relatively downstream range in the direction of the sub-scanning, wherein the first image is printed with the first-use dot-forming element group solely, and the second image is printed with the first-use dot-forming element group solely.

* * * * *